US005570166A

United States Patent [19]

Ohzeki et al.

[11] Patent Number: 5,570,166

[45] Date of Patent: Oct. 29, 1996

[54] DEVELOPING APPARATUS THAT APPLIES VOLTAGE TO DEVELOPER LAYER THICKNESS REGULATING MEMBER

[75] Inventors: Yukihiro Ohzeki, Yokohama; Masaki Ojima, Inagi; Katsuhiro Sakaizawa, Kawasaki; Kenya Ogawa, Yokohama, all of Japan

[73] Assignee: Canon Kabushiki Kaisha, Tokyo, Japan

[21] Appl. No.: 345,394

[22] Filed: Nov. 18, 1994

[30] Foreign Application Priority Data

| | | | |
|---|---|---|---|
| Nov. 19, 1993 | [JP] | Japan | 5-314584 |
| Dec. 17, 1993 | [JP] | Japan | 5-344212 |
| Dec. 27, 1993 | [JP] | Japan | 5-348358 |

[51] Int. Cl.[6] ..... G03G 15/09

[52] U.S. Cl. ..... 355/251; 355/253

[58] Field of Search ..... 355/251, 253, 355/259; 118/656, 657

[56] References Cited

U.S. PATENT DOCUMENTS

| | | | |
|---|---|---|---|
| 4,382,420 | 5/1983 | Ohnuma et al. | 118/656 X |
| 4,444,864 | 4/1984 | Takahashi | 118/657 X |
| 4,480,911 | 11/1984 | Itaya et al. | 355/211 |
| 4,498,756 | 2/1985 | Hosoya et al. | 355/259 |
| 4,804,995 | 2/1989 | Osawa et al. | 118/657 X |
| 5,168,312 | 12/1992 | Aoto et al. | 355/259 |
| 5,183,964 | 2/1993 | Stelter et al. | 355/259 X |
| 5,210,617 | 5/1993 | Tomiyama et al. | 355/259 X |
| 5,255,057 | 10/1993 | Stelter et al. | 355/251 X |
| 5,353,104 | 10/1994 | Kato et al. | 355/259 |

FOREIGN PATENT DOCUMENTS

| | | |
|---|---|---|
| 58-149076 | 9/1983 | Japan . |
| 63-52165 | 3/1988 | Japan . |

*Primary Examiner*—Nestor R. Ramirez

*Attorney, Agent, or Firm*—Fitzpatrick, Cella, Harper, & Scinto

[57] ABSTRACT

An image forming apparatus includes an image bearing member for bearing an electrostatic image; a developer carrying member, opposed to the image bearing member, for carrying a one component developer which is charged to a predetermined polarity by friction between the developer and the developer carrying member; an electric field generating device for generating, between the image bearing member and developer carrying member, an electric field for developing the electrostatic image on the image bearing member with a reverse development method; a regulating member for regulating an amount of the developer on the developer carrying member; and a voltage applying device for applying to the regulating member, a voltage having a polarity opposite the predetermined polarity.

18 Claims, 22 Drawing Sheets

DEVELOPING APPARATUS THAT APPLIES VOLTAGE TO DEVELOPER LAYER THICKNESS REGULATING MEMBER

FIELD OF THE INVENTION AND RELATED ART

The present invention relates to an image forming apparatus such as an electro-photographic apparatus or electrostatic recording apparatus, and more particularly to an image forming apparatus comprising a developing apparatus in which the thickness of a layer of developer borne on a developer carrying member is regulated by a regulating member.

FIG. 8 depicts an example of a developing apparatus employed as an image forming apparatus of the electrophotographic type.

A developing apparatus 140 comprises a developer container 140*a* containing electrically insulating magnetic toner T, which is an electrically insulating one component developer (in this example, a toner chargeable to a negative polarity). In the developer container 140*a*, a cylindrical developing sleeve 102 that is a developer carrying member is disposed adjacent to a photosensitive drum 100. This developing sleeve 102 is made of nonmagnetic metallic material such as aluminum or stainless steel. The gap between the photosensitive drum 100 and developing sleeve 102 is maintained to be approximately 300 μm by a gap regulating member (unillustrated).

Also in the developing sleeve 102, a magnetic roller 104 that is a magnetic field generating means is concentrically disposed with a predetermined gap. The magnetic roller 104 is fixed to the main assembly of the image forming apparatus and does not rotate, whereas the developing sleeve 102 concentrically rotates about the magnetic roller 104 fitted within the developing sleeve 102.

The magnetic roller 104 has four magnetic poles S1, S2, N1, and N2 as shown in the drawing, wherein the magnetic pole S1 is a developing pole; the magnetic pole N1 is a toner amount regulating pole; the magnetic pole S2 is a pole for collecting-delivering the toner; and the magnetic pole N2 is a pole for preventing the toner from backing out.

The magnetic toner T contained in the developer container 140*a* is attracted onto the developing sleeve 102, and borne thereon by the magnetic force of the magnetic roller 104 disposed within the developing sleeve 102, and is conveyed to the developing station where it closely faces the photosensitive drum 100 as the developing sleeve 102 rotates in the direction of an arrow B.

An elastic blade 103 as a toner amount regulating member is fixed to the container 140*a*, at a location above the developing sleeve 102. This elastic blade 103 extends downward and elastically contacts developing sleeve 102 to regulate the toner borne on the developing sleeve 102 to form a thin layer of toner, in other words, to regulate the amount of toner to be conveyed to the developing station. The amount of the toner to be conveyed to developing station is determined in accordance with the contact pressure, contact area length, and the like, of the elastic blade 103 contacting the developing sleeve 102. It is customary to regulate the amount of the toner to be conveyed per unit surface area of the developing sleeve 102 to be 1.0–2.0 mg/cm$^2$.

During the developing operation, toner having been delivered to the developing station is affected by the electrical field induced by the developing bias applied between the developing sleeve 102 and the elastic blade 103, whereby it is flown from the developing sleeve 102 to the surface of photosensitive drum 100 rotating in the direction of an arrow A, where it adheres to a latent image having been formed on photosensitive drum 100, visualizing thereby the latent image as a toner image.

As for the developer, developer other than the aforementioned one is sometimes used, for example, an electrically insulating nonmagnetic one component developer (electrically insulating nonmagnetic toner), a double component developer composed of electrically insulating nonmagnetic toner and magnetic carrier, or a two component developer composed of electrically insulating magnetic toner and non-magnetic or magnetic carrier.

In the case of the developing apparatus illustrated in FIG. 8, the charge carried by the magnetic toner T is tribo-electrically generated through friction between the toner and the elastic blade 103, and the developing sleeve 102. However, it has become evident that such a system suffers from the following problems.

The polarity of the charge imparted to the toner T is determined by the toner material itself, the developing sleeve 102 material, and the elastic blade 103 material. Further, it is affected by the types and amount of any toner additives, and the contact area width and contact pressure between the elastic blade 103 and the developing sleeve 102. For example, in order to charge the toner to the negative polarity, resin material chargeable to the negative polarity is employed as the resin material for the toner while employing material chargeable to the positive polarity as the material for the elastic blade 103 and the developing sleeve 102.

However, in reality, the toner is tribo-electrically charged not only by and friction between the toner, the elastic blade 103 and the developing sleeve 102, but also by its own internal friction. As a result, a certain amount of toner is reversely charged to a positive polarity (reversal toner), whereas the majority of the toner is normally charged to a negative polarity (normal toner). The amount of this reversal toner is usually approximately 10% of the entire toner. In other words, it is relatively small compared to the amount of negatively charged toner; therefore, the layer of toner coated on the developing sleeve displays a negative polarity as the overall polarity.

However, when the reversal toner is present, it unnecessarily adheres to the non-image area (white area), thereby creating fogginess. As a result, the whiteness of the white area is significantly reduced; therefore, the image quality is deteriorated. Next, it will be described in detail how the fogginess is created by this reversal toner.

The surface of the photosensitive drum 100 is charged to a potential of −700 V, and an electrostatic latent image having a potential of −150 V is formed through exposure by a laser. In the developing apparatus 5 illustrated in FIG. 10, electrically insulating magnetic toner chargeable to negative polarity is employed. During a developing operation, a developing bias composed of a DC voltage of −500 V and an AC voltage superimposed thereon is applied to the developing sleeve 102 to develop the latent image, wherein the AC voltage has a frequency of 1800 Hz and a peak-to-peak voltage of 1640 V. The relation between the potentials on the surfaces of the photosensitive drum 100 and developing sleeve 102 at this time is shown in FIG. 9. In FIG. 9

Potential of non-image area on drum: VD=−700 V

Potential of image area on drum: VL=−150 V

Maximum developing voltage (maximum voltage value of superimposed voltage of DC and AC, on the negative side): Vmax=−1320 V Maximum development-reversing voltage (maximum voltage value of superimposed voltage of DC and AC, on the positive side): Vmin=+320 V Peak-to-peak voltage of AC: Vpp=−1640 V Development contrast: $Vcont=|V_{DC}|-|V_L|$ According to this setup, when the developing bias is in a period T51, negatively charged toner is affected by the maximum developing voltage Vmax (−1320 V), overcoming thereby the magnetic force of the magnet 104, and as a result, it flies away from the developing sleeve 102 to the image portion of the photosensitive drum 100 as well as to the non-image portion. On the other hand, when the developing bias is in a period T52, toner that flies away to the surface of the photosensitive drum 100 during the period T51 files back to the developing sleeve 102 due to the development-reversing maximum voltage Vmin (+320 V) and the magnetic force of the magnet 104. At this time, on the image portion on the photosensitive drum 100, toner carrying a charge amount corresponding to the contrast (Vcont) remains on the image portion of the photosensitive drum 100; in other words, the image portion is developed (that is, developed in reverse).

However, when reversal toner is present on the developing sleeve 102, it flies away from the developing sleeve 102 to the non-image portion on the photosensitive drum 100 and adheres thereon during the period T52, which manifests as fog in the white area of the outputted image, deteriorating significantly the image quality (this fog is due to the reversal toner, and therefore, will be referred to as "reversal fog" when appropriate). Since the amount of this fog is reciprocal to that of the fog created by the negatively charged normal toner during the period T51 (this fog is a fog created by the normal toner, and therefore, will be referred to as "normal fog" when appropriate), it is difficult to reduce the overall amount of the fog.

As a countermeasure, it is conceivable to reduce the AC voltage Vpp of the developing bias in FIG. 9, but reducing the Vpp reduces the sharpness of the edge portions of the image, which causes the produced image to appear rough. Therefore, even though the reversal fog can be reduced by this measure, a high quality image cannot be produced. In other words, in order to reduce the reversal fog in terms of the overall fog, there is no other way but charging normally and uniformly the toner coated on the developing sleeve 102 to the predetermined polarity.

In order to do so, it is conceivable to increase the contact pressure of the elastic blade 103 upon the developing sleeve 102 so that the tribo-electrical charge of the toner by the developing sleeve is facilitated. However, this method also facilitates the tribo-electrical charging of the toner by intra-toner particle friction while facilitating the tribo-electrical charging of the toner by the developing sleeve 102. As a result, it does not significantly reduce the amount of reversal toner.

Therefore, it is conceivable as a second thought to reduce the amount of toner coated (coat amount) on the surface of the developing sleeve 102, which normally is 1.0–2.0 $mg/cm^2$ for example to approximately 0.3 $mg/cm^2$ so that chance of contact between the toner and surface of the developing sleeve 102 is increased while reducing the tribo-electrical charging of the toner by intra-toner particle friction. This method should increase the chance of contact between the reverse toner and the surface of the developing sleeve 102 so that the amount of reversal toner can be reduced.

However, since this method reduces the amount of coating of the toner, it reduces the density of the outputted image. In order to counter this shortcoming, it is necessary to increase the rotational speed of the developing sleeve 102 relative to that of the photosensitive drum 100 so that the amount of toner supplied to the developing station is increased, wherein increasing the rotational speed of the developing sleeve 102 requires an increase in the driving torque of the developing sleeve 102, which invites various problems.

In Japanese Laid-Open Patent Application No. 52,165/1988, a method is disclosed in which an electrically conductive developing blade is employed along with a developing sleeve comprising a resistive surface layer with a resistance of $10^6-10^{12}$ Ω/cm, wherein, in order to charge the toner, a voltage is applied to the developing blade to inject a charge into the toner.

However, when toner charging is dependent on the injection of charge having the desired polarity into the toner, the voltage leaks; therefore, a high voltage cannot be applied to the developing blade, and as a result, the thickness of the toner layer cannot be increased.

Also, Japanese Laid-Open Patent Application No. 149,076/1983 discloses a method in which, in order to reduce the thickness of the toner layer, a voltage having a polarity opposite to the toner polarity is applied to a hard blade.

However, this method relates to normal development process, and does not prevent the fog caused by the reversal toner, nor does it utilize friction between the elastic material regulating member and toner.

SUMMARY OF THE INVENTION

A principal object of the present invention is to provide an image forming apparatus in which reversal toner is eliminated while toner is tribo-electrically charged.

Another object of the present invention is to provide an image forming apparatus capable of carrying out a reversal development process without creating reversal fog.

According to an aspect of the present invention, there is provided an image forming apparatus that includes an image bearing member for bearing an electrostatic image; a developer carrying member, opposed to the image bearing member, for carrying a one component developer which is charged to a predetermined polarity by friction between the developer and the developer carrying member; electric field generating means for generating, between the image bearing member and the developer carrying member, an electric field for developing reversely the electrostatic image on the image bearing member; a regulating member for regulating an amount of the developer on the developer carrying member; and voltage applying means for applying to the regulating member a voltage having a polarity opposite from the predetermined polarity.

These and other objects, features, and advantages of the present invention will become more apparent upon consideration of the following description of the preferred embodiments, in conjunction with the accompanying drawings.

DETAILED DESCRIPTION OF THE PREFERRED EMBODIMENTS

Hereinafter, the embodiments of the present inventions will be described.

Figure 1:
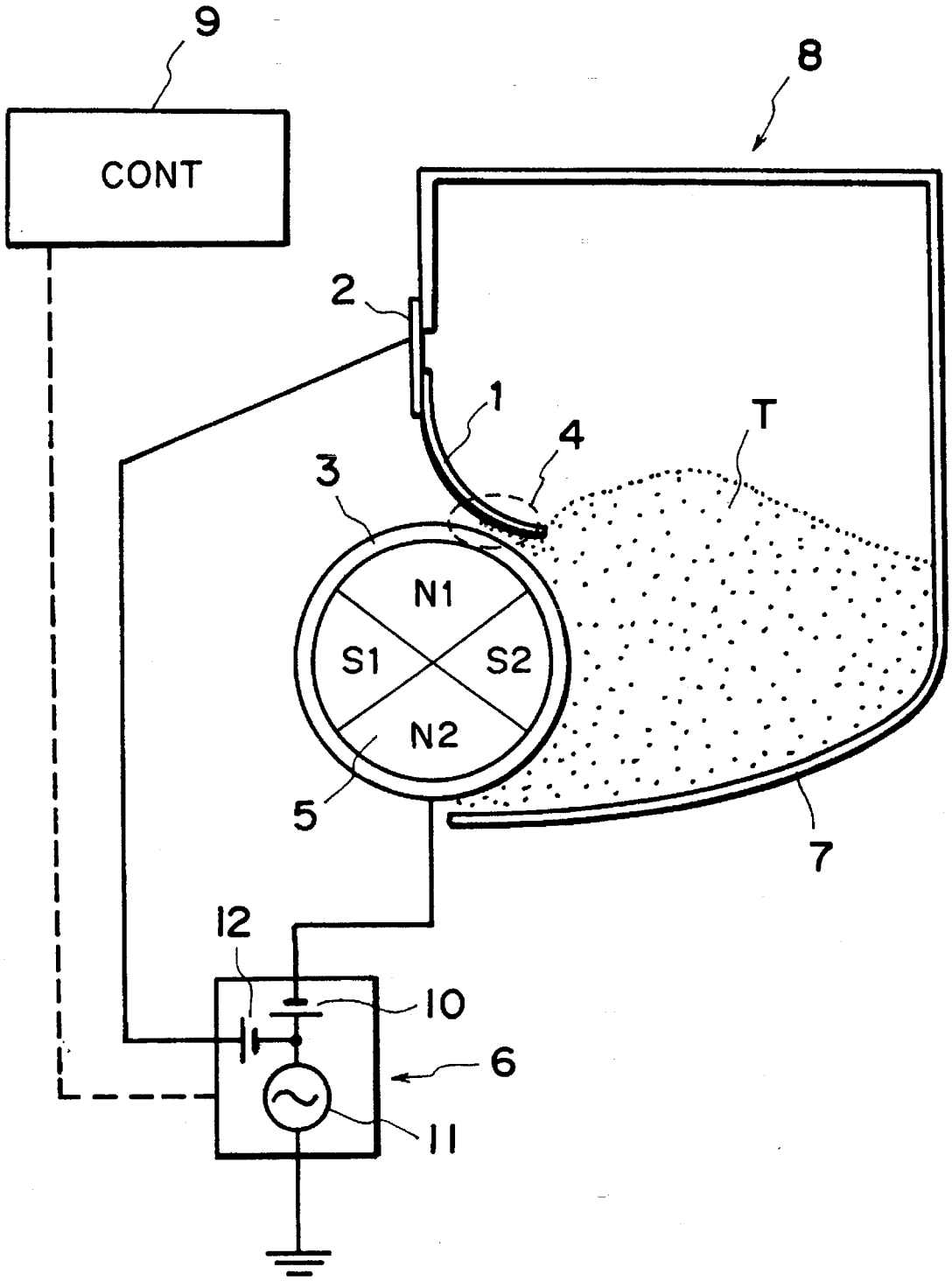
FIG. 1 is a schematic structural view of an embodiment of developing apparatus according to the present invention.

FIG. 1 is a schematic structural view of a preferred embodiment of a developing apparatus according to the present invention. Referring to FIG. 1, this developing apparatus 8 comprises a developer container 7 containing toner T that is a one component developer, a fixed magnet roller 5, a non-magnetic developing sleeve 3, and a developing blade 1 as a developer regulating member. The magnetic roller 5 is enveloped in the developing sleeve 3. The developing sleeve 3 is disposed at the opening of the developer container 7 and rotates facing closely the photosensitive drum (unillustrated). The developing blade 1 is disposed also at the opening, above the developing sleeve 3, so as to extend in the direction opposite to the rotational direction of the developing sleeve 3 while making contact with the developing sleeve 3.

The developing sleeve 3 faces the photosensitive drum bearing an electrostatic image, which will be described later, with a predetermined gap formed therebetween.

Figure 2:
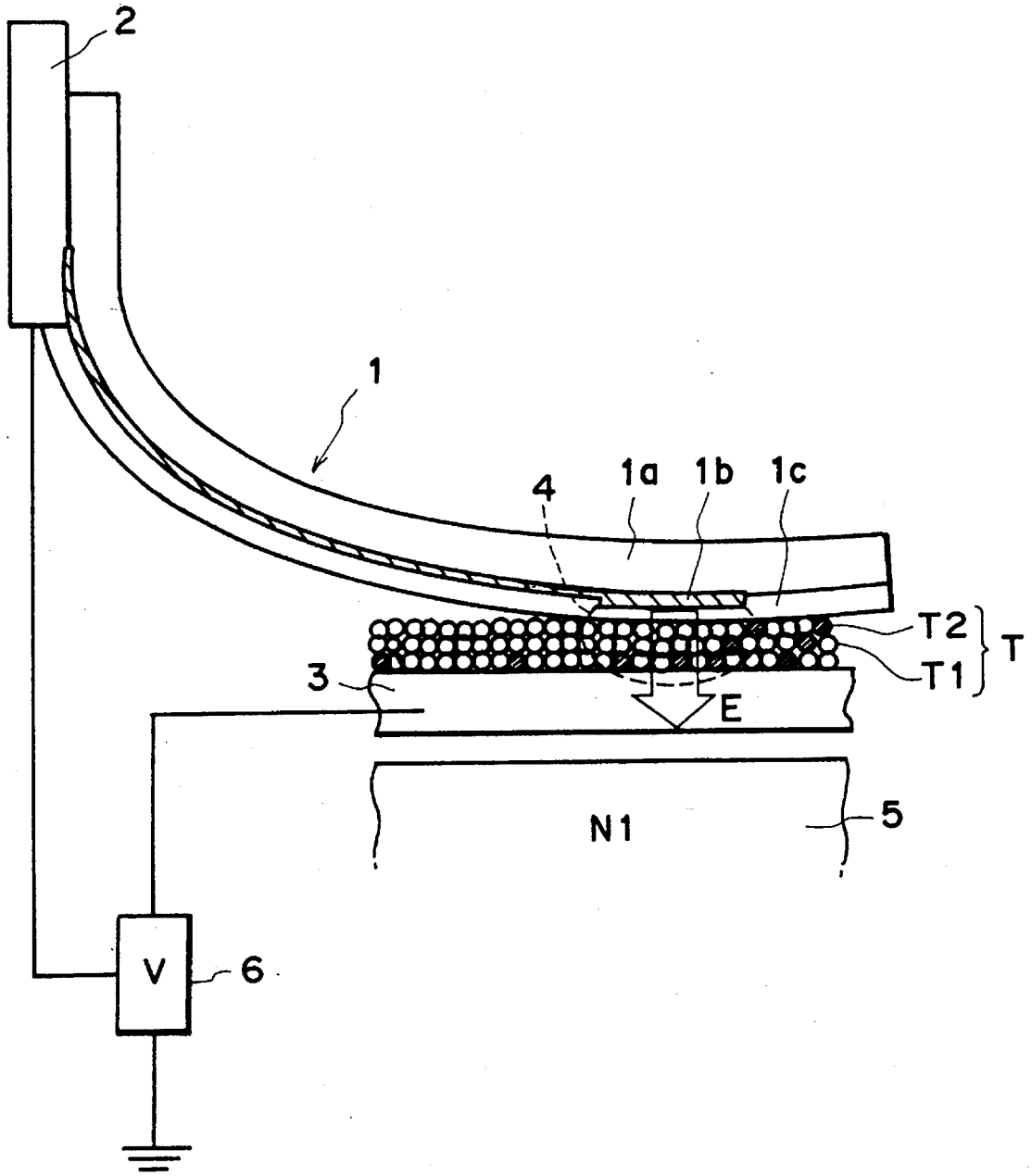
FIG. 2 is an enlarged view of the developing blade provided in the developing apparatus of FIG. 1.

FIG. 2 is an enlarged section of the developing blade 1.

Referring to FIG. 2, the developing blade 1 comprises: an electrically nonconductive, soft, elastic member 1*a*, an electrically conductive layer 1*b* laminated, thereby supported, on the elastic member 1*a*, and a dielectric layer 1*c* laminated on the electrically conductive layer 1*b*, on the surface facing the developing sleeve 3. The developing blade 1 is a blade-shaped, electrically conductive rigid member, and in this embodiment, it is indirectly glued to the developing container 7 through a steel blade 2. With this arrangement, the developing blade 1 is placed in contact with the surface of the developing sleeve 3, with a predetermined pressure.

Figure 3:
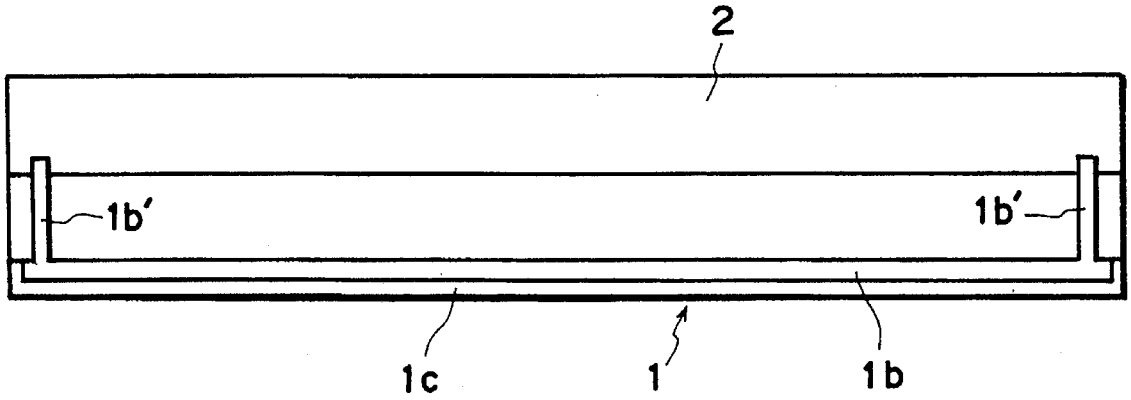
FIG. 3 is a side view of the developing blade illustrated in FIG. 2, in a state in which an elastic member has been removed.

FIG. 3 is a side view of the developing blade 1 illustrated in FIG. 2, as seen from the right side of FIG. 2, in a state in which the elastic member 1*a* has been removed. As shown in FIG. 3, the electrically conductive layer 1*b* of the developing blade 1 is electrically connected to the steel blade 2 by electrically conductive portions 1*b'* which extend from the respective longitudinal ends of the developing blade 1.

As for the material for the elastic member 1*a*, soft elastic material is employed. It does not need to be electrically conductive since the developing blade 1 comprises the electrically conductive layer 1*b*, and therefore, electrically non-conductive material is employed. For example, urethane rubber or the like may be employed. As to the material for the electrically conductive layer 1*b*, basically, any material is usable as long as it is flexible and of low resistance. Typically, it is formed of electrically conductive primer or the like in which carbon is dispersed (electrically conductive paint, electrically conductive adhesive, or the like). As the material for the dielectric layer 1*c*, material having flexibility, electrically insulating properties, as well as a large dielectric constant, is used, wherein the dielectric layer 1*c* is preferred to be formed as a thin layer. For example, dielectric material such as urethane, PFA, PTFE, polyesther, polyimide, or polyamide can be used. In this embodiment, polyamide 66 (nylon 66) (dielectric constant $\varepsilon$=4.3, volummetric resistivity $\rho=10^{13}$ Ω/cm) was used to form the dielectric layer 1*c* having a thickness of 20 μm.

As described in the foregoing, the developing blade 1 is attached to the developing container 7 by a steel blade 2 so as to be pressed upon the developing sleeve 3. As a result, a nip 4 is formed between the developing blade 1 and developing sleeve 3, whereby a predetermined amount of the toner T is coated on the surface of the developing sleeve 3 to a width equivalent to that of the nip 4.

In this embodiment, insulating magnetic toner chargeable to a negative polarity is used as the toner T. It may be, for example, such insulating non-magnetic toner that is basically composed of binder resin, the main ingredient of which is styrene-acrylic copolymer, magnetite (60% by weight), and metallic complex salt of mono-azoic dye (1% by weight), and has a volummetric resistivity of $10^{13}$ Ω/cm, wherein silica particles imparted with hydrophobicity for increasing its flowability is added (0.4% by weight relative to the weight of the toner).

The developing sleeve 3 is made of, for example, aluminum; the surface of an aluminum pipe is machined to give a predetermined external diameter and is sandblasted with ALUNDUM #400 (abrasive of alundum, product of Showa Denko K. K.) to give a central line average height Ra (defined in JISB-0601) of approximately 0.5 μm.

The magnetic roller 5 is concentrically disposed within the developing sleeve 3, forming a predetermined gap therebetween. Referring to FIG. 1, the magnetic roller 5 comprises a magnetic pole S1 that is a developing pole, a magnetic pole N2 that is a pole for preventing the toner from backing out, a magnetic pole S2 that is a toner delivering pole, and a magnetic pole N1 that is a toner amount regulating pole, all of which are formed by magnetization. In this embodiment, the strength of the magnetic poles is 80 mT for the pole S1, 65 mT for the pole S2, 60 mT for the pole N1, and 70 mT for the pole N2.

Superimposed voltage applying means 6, as an electrical field generating means, which is a characteristic component of the present invention, is connected to the developing sleeve 3, and a controller 9 is connected to this voltage applying means 6 in order to control the operation of the voltage applying means 6. The voltage applying means 6 comprises an AC power source 11, and DC power sources 10 and 12 which are connected to the AC power source 11. DC power source 10 is connected to the developing sleeve 3, and DC power source 12 is connected to the steel blade 2 of the developing blade 1. In this embodiment, the AC voltage of the power source 11 is given a frequency of 1,800 Hz and a peak-to-peak voltage of 1,640 Vpp. The DC voltage of the power source 10 is −500 V, and the DC voltage of the power source 12 is +500 V.

The DC power source 12 is for applying an electrical field generating voltage to the developing blade 1 so that an electrical field is generated between the developing blade 1 and developing sleeve 3 in the nip 4; as +500 V having a polarity opposite to that of the toner is applied to the developing blade 1, an electrical field having a potential difference of 1,000 V is generated toward the developing sleeve 3 imparted with −500 V by the DC power source 10.

Since a DC voltage (−500 V) is applied to the developing sleeve 3 by the DC power source 10, an electrical field is formed between the developing blade 1 and developing sleeve 3 even if the DC power source 12 is omitted. However, the omission of the DC power source 12 causes the electrical field to be weaker compared to when the voltage from the DC power source 12 is also applied. Therefore, the presence of the DC power source 12 is preferable in order for the present invention to be more effective.

Next, the operation of the developing apparatus according to the present invention will be described. Referring again to FIG. 1, when an image forming apparatus, which will be described later, comprising a developing apparatus 8 begins to operate, the controller 9 issues a command to rotate the developing sleeve 3, and at the same time, a command to drive the voltage applying means 6, which causes the superimposed voltage (developing bias) composed of the an AC voltage of −500 V and DC voltage of 1,640 V (1,800 Hz) to be applied to the developing sleeve 3, and also, causes the superimposed voltage (blade bias) composed of the DC voltage of +500 V and the AC voltage of 1,640 V (1,800 Hz) to be applied to the electrically conductive layer of the developing blade 1. As a result, an electrical field E having a potential difference of 1000 V is developed between the developing blade 1 and developing sleeve 3 in the nip 4, in the direction from the developing blade 1 to the developing sleeve 3.

Before the toner T on the surface of the developing sleeve 3 is introduced into the nip 4, it is tribo-electrically charged by the intra-toner friction of the toner T itself as well as the friction between the toner T and the surface of the developing sleeve 3. As described previously, when the toner T is charged by intra-toner friction, some of the toner is charged to the positive polarity, becoming the reversal toner. In other words, it is charged to the polarity opposite to the normal polarity that is the negative polarity. Therefore, a normal toner T1 having been charged to the negative polarity and a reversal toner T2 having been charged to the positive polarity are mixedly present in the layer of the toner T before it enters the nip 4.

Conventionally, the electrical field E such as shown in FIG. 2 has not been imparted within the nip 4; therefore, the distribution state of the reversal toner T2 and normal toner T1 in the nip 4 is maintained, and the distribution state of the mixed presence of the reversal toner T2 and normal toner T1 is rather amplified, thus increasing the amount of the reversal toner T2.

Figure 4:
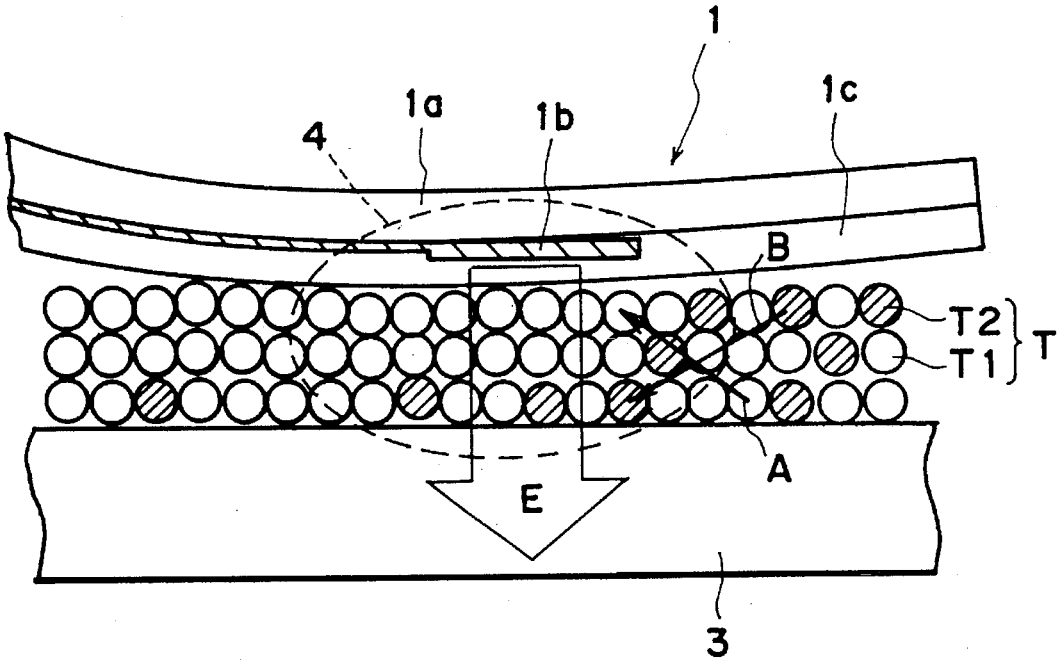
FIG. 4 is a drawing for describing the toner movement in the region where the developing blade and developing sleeve make contact.

On the contrary, according to the present invention, the electrical field E that directs the reversal toner T2 toward the developing sleeve 3 is imparted within the nip 4; therefore, the reversal toner T2 can be reduced. In other words, referring to FIG. 4, which is an enlarged view of the nip 4 illustrated in FIG. 2, a force A that attracts the normal toner T1 toward the developing blade 1 and a force B that attracts the reversal toner T2 toward the surface of the developing sleeve 3 are generated within the nip by the electrical field E. As a result, re-distribution of the toners T1 and T2 occurs within the nip 4; the reversal toner T2 moves closer to the surface of the developing sleeve 3, increasing its opportunity to come in contact therewith, and when it makes contact with the surface, it is tribo-electrically changed into the normal toner T1.

Therefore, the fog that could have been otherwise created by the reversal toner does not appear when the electrostatic image on the image bearing member is reversely developed. Here, it should be noted that the reversal development means a developing method in which the low potential portions of the electrostatic image are developed as the image portions and the high potential portions are developed as the non-image portions; in the electro-photographic system, the electrostatic latent image is visualized by adhering the developer onto the exposed portions.

In this embodiment, the developing blade 1 comprises a flexible elastic member 1*a*, which gives flexibility and elasticity to enable the developing blade 1 to absorb the pressure from the toner in the nip 4. Therefore, the toner is not packed, and is not prevented from being moved by the electrical field E. Also, the soft and elastic properties of the developing blade 1 allows the nip 4 between the developing blade 1 and developing sleeve 3 to be larger, which in turn allows the force of the electrical field E to reach further. Therefore, the reversal toner T2 can always have a much better chance to make contact with the surface of the developing sleeve 3.

Thus, the reversal toner can be eliminated so that the developing process can be preferably carried out to produce an image with no reversal fog.

Figure 5:
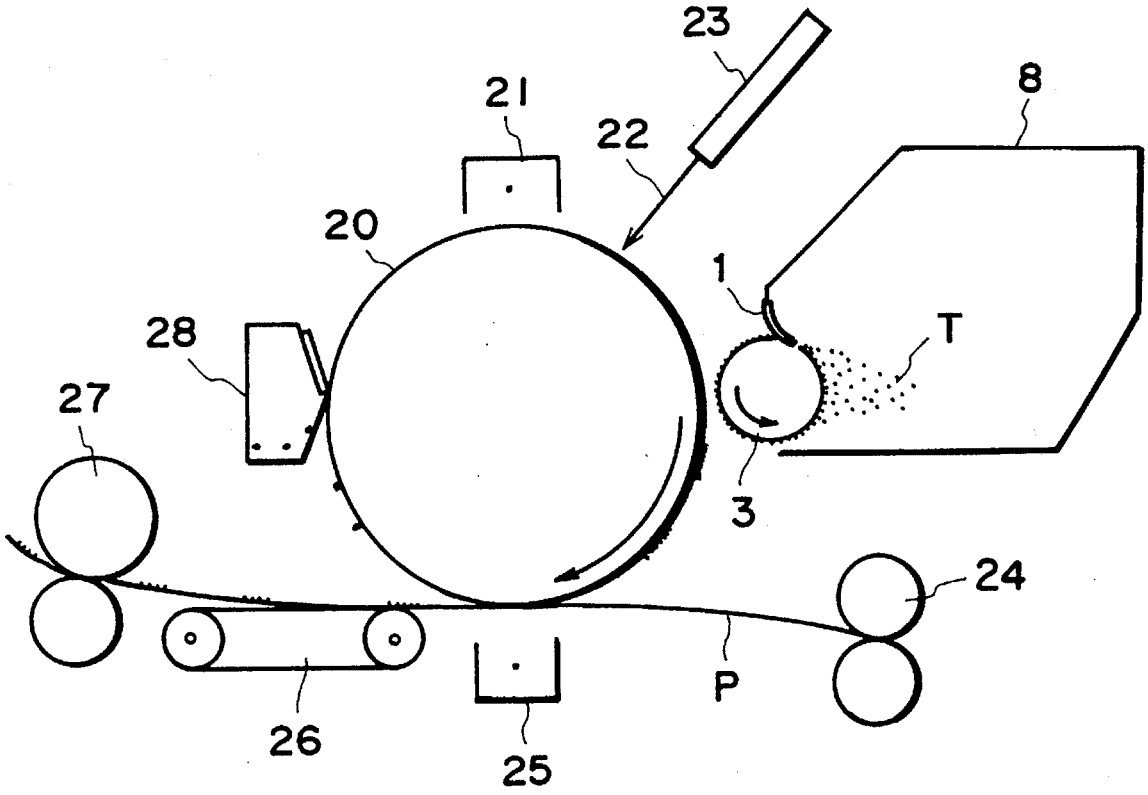
FIG. 5 is a schematic structural view of an image forming apparatus employing the developing apparatus illustrated in FIG. 1.

FIG. 5 shows a typical image forming apparatus in which the developing apparatus of this embodiment is applied. When an image forming operation is started, an unillustrated main motor is driven, whereby a photosensitive drum 20 is rotated in the direction of an arrow. Next, a voltage is applied to a primary charger 21, whereby the surface of the photosensitive drum 20 is charged to a predetermined potential. In this case, the photosensitive drum 20 is charged to −500 V. Then, the surface of the photosensitive drum 20 is exposed with a laser light 22 irradiated from an exposing apparatus 23, whereby an electrostatic latent image is formed on the photosensitive drum 20. The latent image on the photosensitive drum 20 is developed into a visual image by a developing apparatus 8.

In the developing apparatus 8, a voltage is applied to the developing sleeve 3 and developing blade 1 as soon as the developing sleeve 3 begins to rotate as described previously, whereby an electrical field is induced in the direction from the developing blade 1 toward developing sleeve 3 in the nip 4 between the developing blade 1 and developing sleeve 3, whereby the toner T on the surface of the developing sleeve 3 is preferably charged. In other words, the reversal toner is reduced while the toner T is charged to a predetermined negative polarity. The toner T charged to the negative polarity is held on the surface of the developing sleeve 3 by the magnetic force and is delivered to a region where it closely faces the photosensitive drum 20. In this region, the electrostatic latent image on the photosensitive drum 20 is reversely developed by the developing bias applied to the region where the surfaces of the photosensitive drum 20 and developing sleeve 3 become closest to each other.

In this embodiment, the reversal toner is significantly reduced at this time while the toner T is preferably charged to the negative polarity; therefore, the amount of the reversal toner which adheres to the non-image portions of the photosensitive drum 20 is small, and as a result, a toner image with no reversal fog can be produced.

The toner image thus obtained is transferred onto a transfer material P having been delivered to the photosensitive drum 20 by a registering roller 24, and then, the transfer material P is sent to a fixing apparatus 27 by a conveyer belt 26, where the toner image is fixed by heat and pressure. Finally, the transfer material P bearing the fixed image with no reversal fog is outputted.

When the image formation described in the foregoing was carried out while the environmental conditions were varied in a temperature range of 10° C.–33° C. and a relative humidity range of 10% RH–90% RH, preferable images with no reversal fog were obtained under all conditions. As is evident from these results, a preferable image suffering from no reversal fog can be stably obtained under all conditions by generating an electrical field that forces the reversal toner to be re-distributed toward the developing sleeve surface in the nip 4, that is, the contact portion between the developing blade 1 and developing sleeve 3.

Embodiment 2

Figure 6:
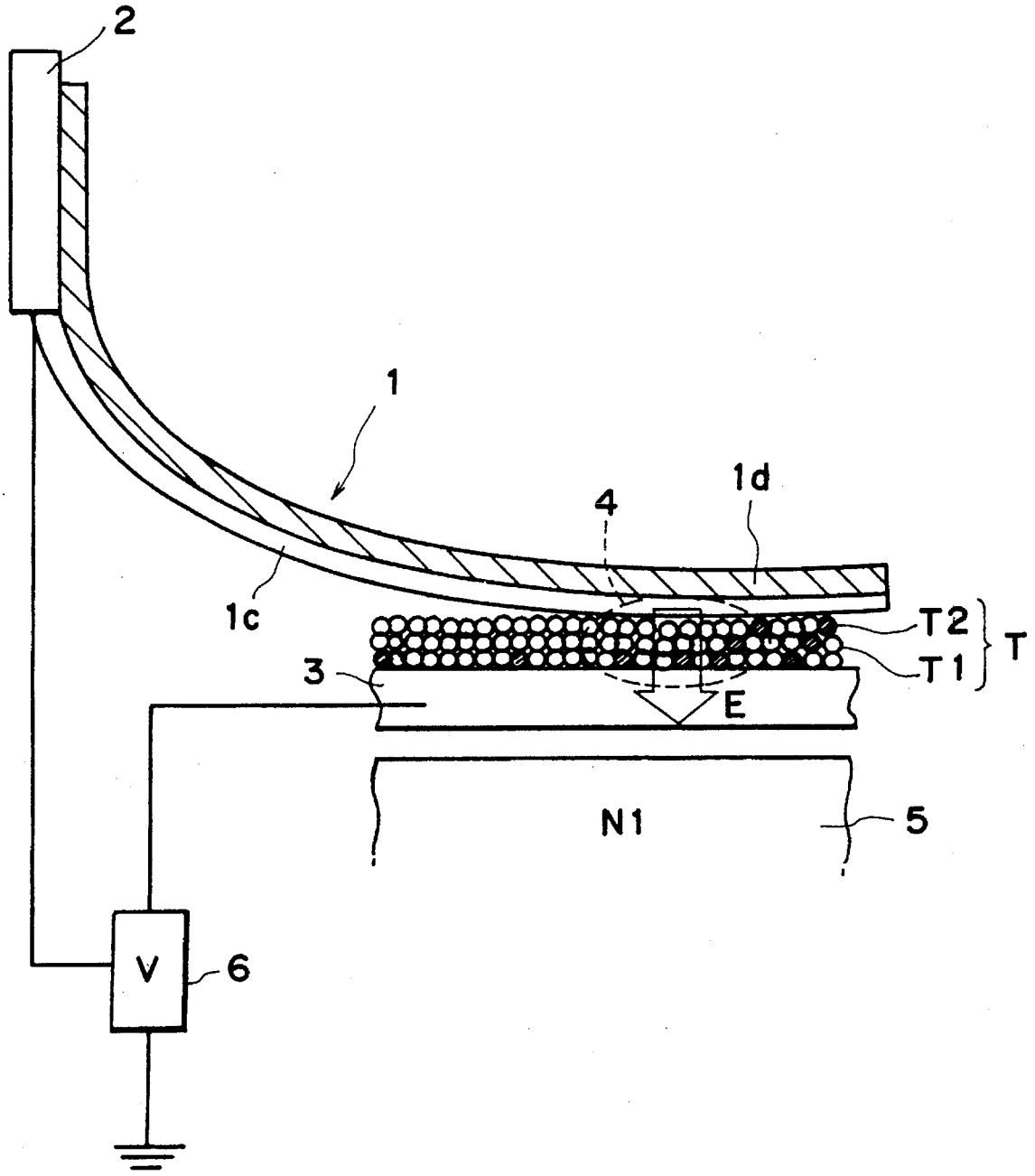
FIG. 6 is an enlarged view of the developing blade provided in another embodiment of the developing apparatus according to the present invention.

FIG. 6 is a drawing for depicting the developing blade and its surroundings in a different embodiment of the developing apparatus according to the present invention. This embodiment is characterized in that the electrically non-conductive soft elastic member 1*a* of the developing blade 1 in Embodiment 1 described referring to FIGS. 1–4, and electrically conductive layer 1*b* provided thereon, are replaced with a single electrically conductive soft elastic member 1*d* that has a combined function of these two components, as shown in FIG. 6. The developing blade 1 of this embodiment comprises the electrically conductive soft elastic member 1*d*, and at least a dielectric layer 1*c* that faces developing sleeve 3. The other structures of this embodiment are basically the same as those in Embodiment 1. In FIGS. 2 and 6, the same reference numerals designate the same members.

As for the material for the elastic member 1*d*, electrically conductive soft elastic material is used. For example, urethane rubber or the like in which carbon is dispersed can be used. This elastic member 1*d* is directly placed in contact with the steel blade 2 with which the developing blade 1 is attached to the developer container 7, and is electrically connected to the superimposed voltage applying means 6 through the steel blade 2.

Also in the case of this embodiment, the reversal fog is effectively reduced by applying a voltage to the developing blade 1 with the use of the voltage applying means 6, as it is in Embodiment 1. Further, since the elastic blade 1 of this embodiment has a laminated structure, it has an advantage in that it can be produced with lower cost than that of Embodiment 1.

Embodiment 3

In Embodiments 1 and 2, a sandblasted aluminum pipe was used as the developing sleeve 3. In this embodiment, the developing sleeve 3 is characterized in that an 8 μm to 22 μm thick electrically conductive resin layer (phenol resin in this embodiment) in which graphite particles are dispersed is formed on the aluminum pipe surface, wherein this resin is chargeable to a polarity opposite the toner charge polarity.

Since the graphite does not form an oxide film on its surface as metal generally does, its contact resistance is always low, and since it has crystal faces with cleavage, it excels in separative properties. Therefore, when an electrically conductive layer, the main ingredient of which is graphite, is formed on the surface of the developing sleeve 3, the developing sleeve 3 becomes resistant to contamination caused by super-microscopic resin components or the like within the toner or the additives. Therefore, the reversal toner T2 is further reduced by this embodiment. In other words, the effect of the present invention is enhanced by this embodiment.

Embodiment 4

Figure 7:
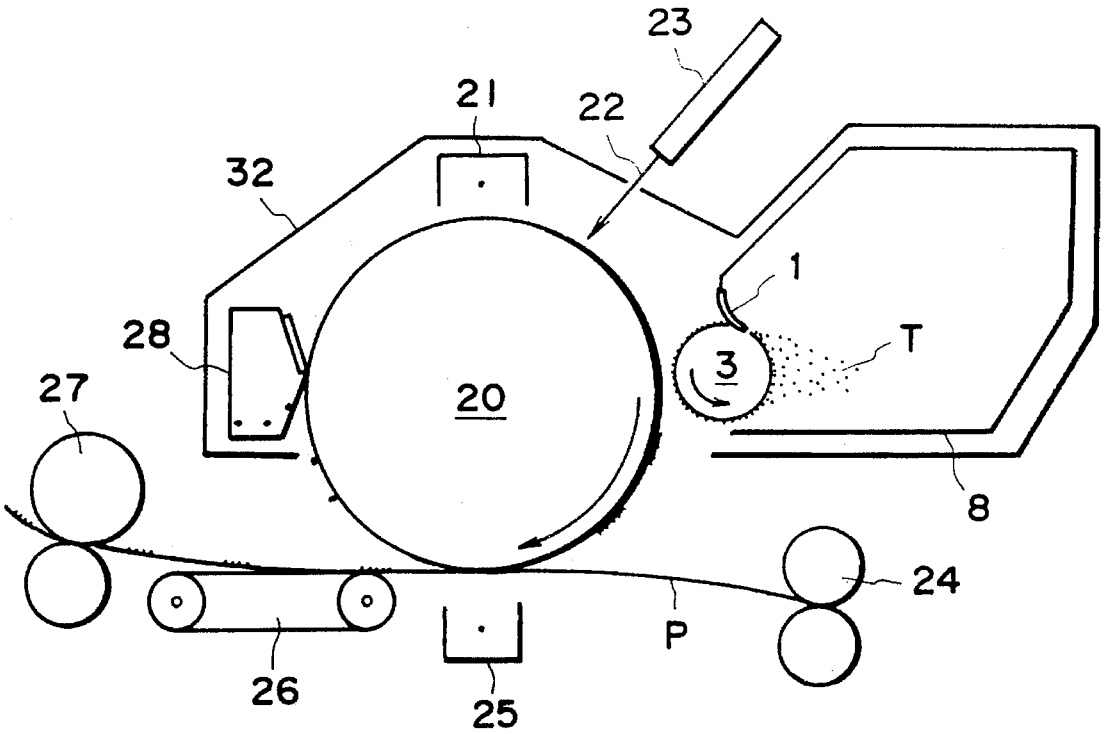
FIG. 7 is a schematic structural view of a process cartridge to which a further embodiment of the present invention is applicable.
Figure 8:
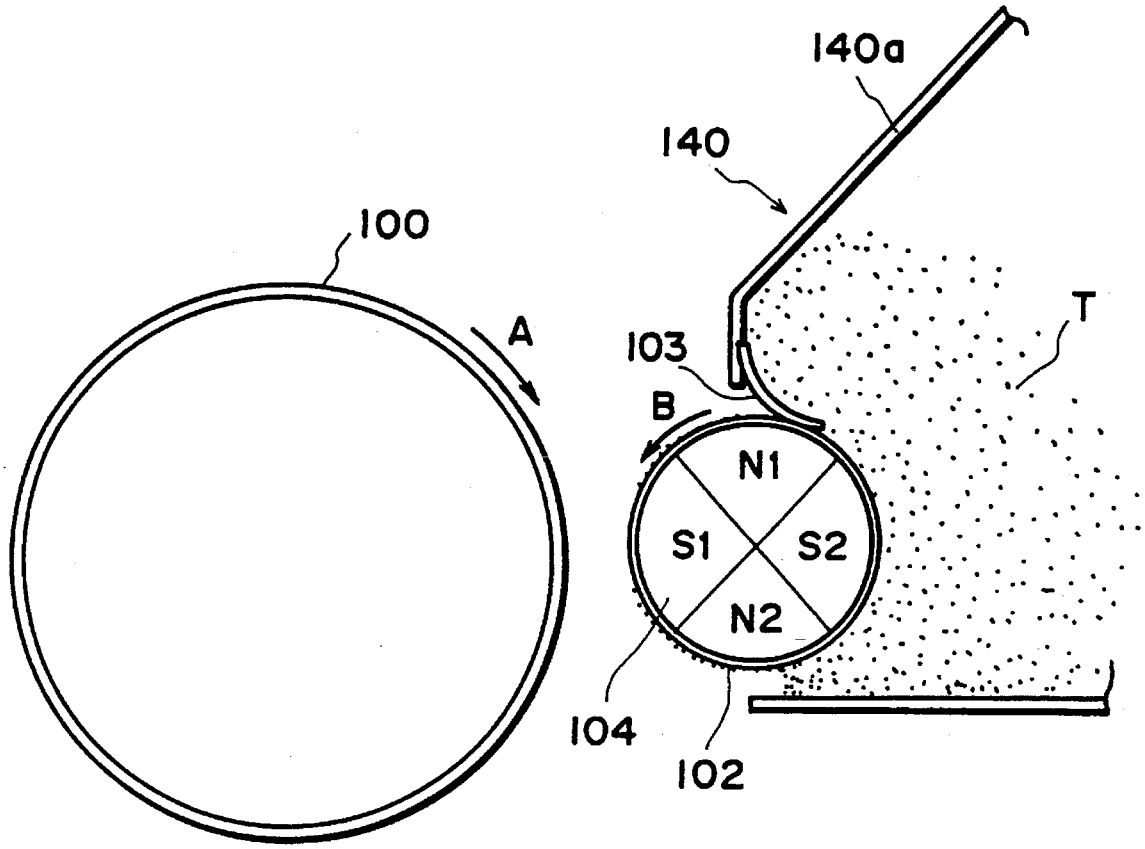
FIG. 8 PRIOR ART
FIG. 8 is a section of a typical developing apparatus.
Figure 9:
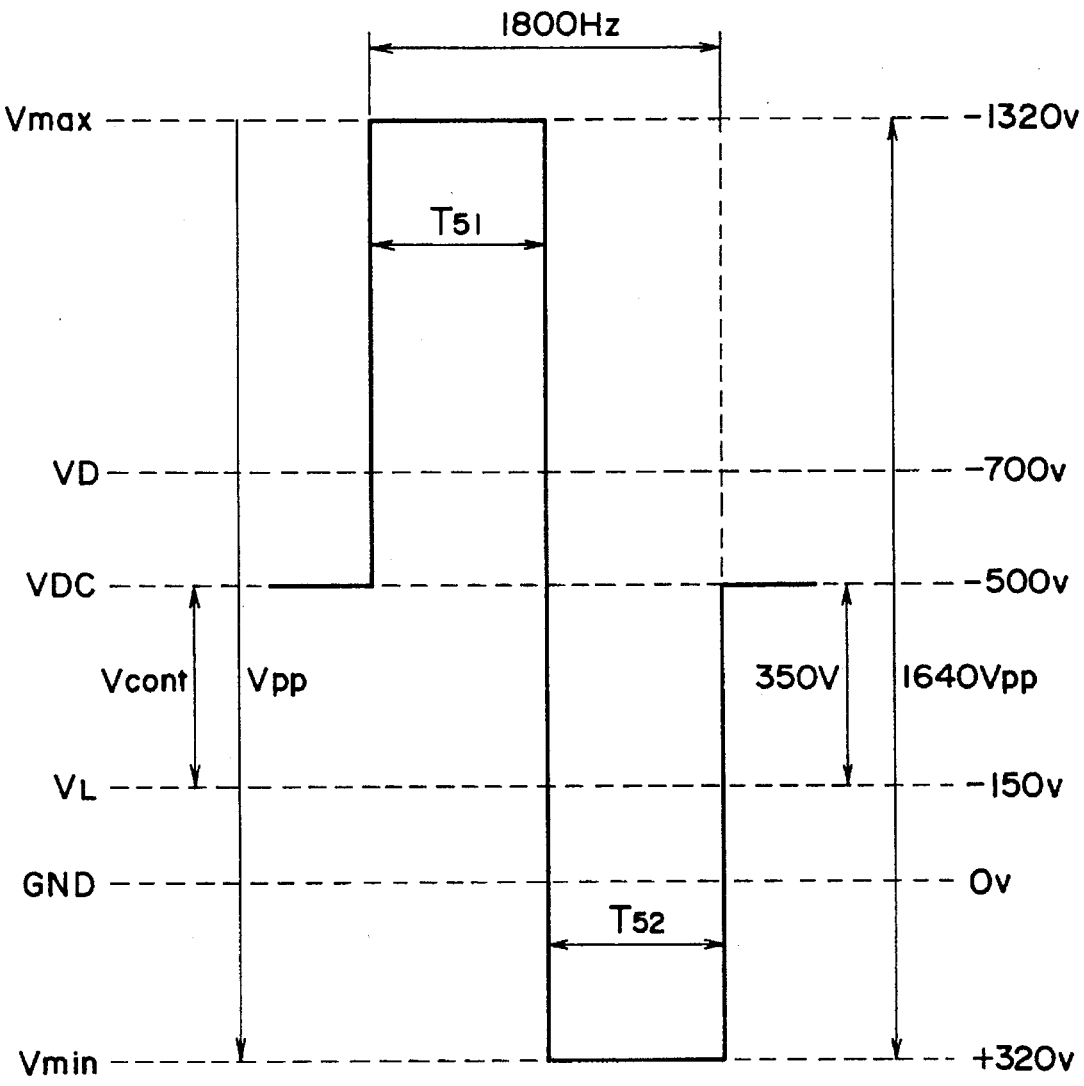
FIG. 9 is a graph showing the relation between the potentials of the photosensitive drum and developing sleeve.

FIG. 7 is a schematic structural view of another embodiment of a developing apparatus according to the present invention. This embodiment represents a case in which the developing apparatus according to the present invention is applied to a process cartridge.

A process cartridge 32 comprises a photosensitive drum 20, a charging corona or roller 21, a developing apparatus 8, and a cleaner 28, which are integrally formed in a single unit. It is removably mounted in the main assembly of an image forming apparatus. In the drawing, an exposing apparatus 23, a registering roller 24, a transferring apparatus 25, a conveying apparatus 26 and a fixing apparatus 27 are disposed on the main assembly side of the image forming apparatus.

Integration of the developing apparatus 8, photosensitive drum 20 or the like into a process cartridge can not only simplify the maintenance and reduce the burden placed on a user, but also, can further enhance the effects of the present invention.

Embodiment 5

Figure 10:
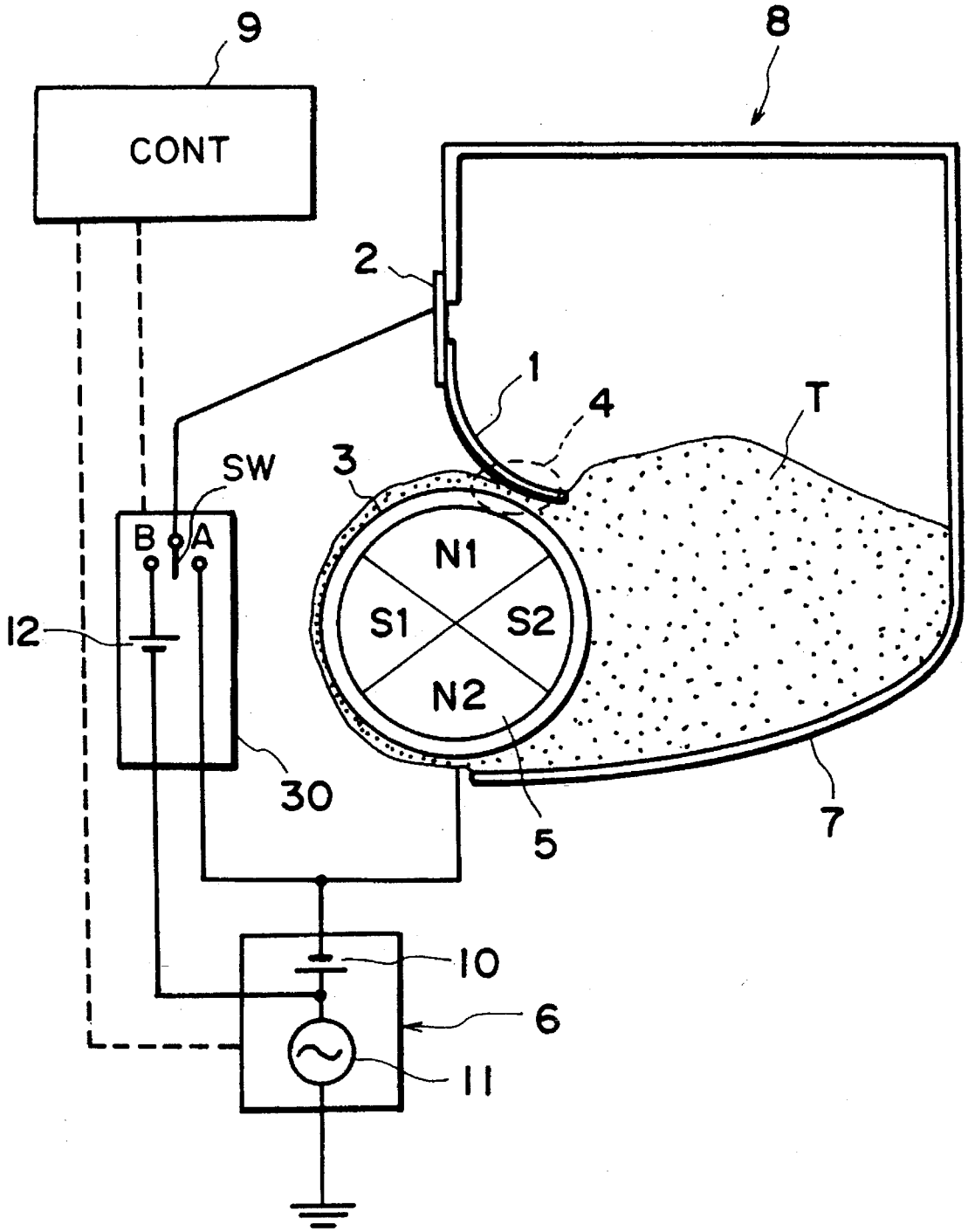
FIG. 10 is a schematic structural view of a further embodiment of the developing apparatus according to the present invention.

FIG. 10 shows another embodiment of the present invention. The developing apparatus 8 of this embodiment comprises a developer container 7 containing toner T that is a one component developer, a fixed magnetic roller 5, a nonmagnetic developing sleeve 3, and a developing blade 1 as the developer regulating member. The developing sleeve 3 envelops the fixed magnetic roller 5 and is rotatively disposed at an opening of the developer container 7, facing closely a photosensitive drum (unillustrated), and the developing blade 1 is attached to the developer container 7, above the developing sleeve 3, being disposed in such a manner as to extend in the direction opposite to the rotational direction of the developing sleeve 3 and contacting developing slevee 3.

Figure 11:
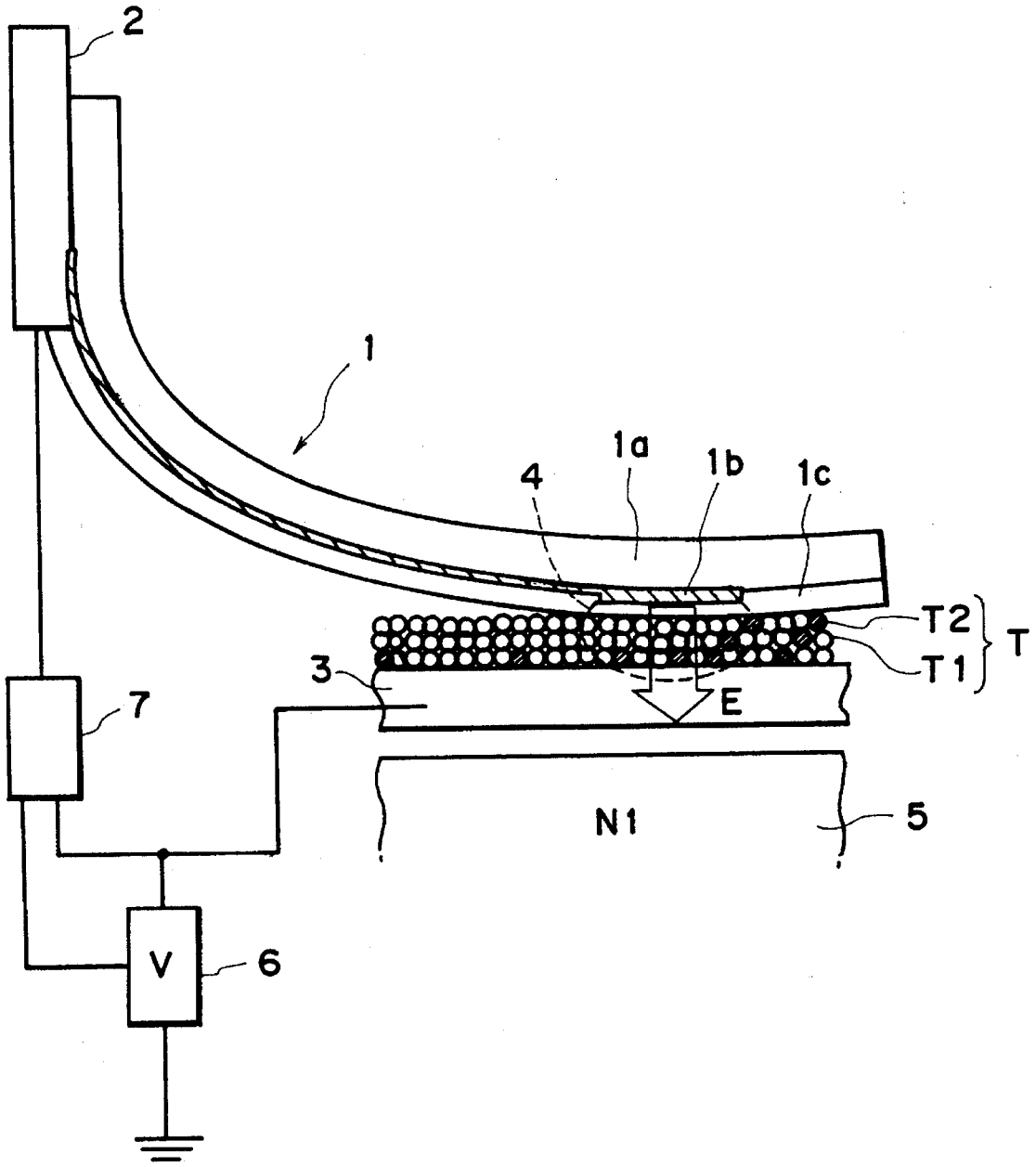
FIG. 11 is an enlarged view of the developing blade provided in the developing apparatus shown in FIG. 10.

Referring to FIG. 11, the developing blade 1 of this embodiment comprises an electrically nonconductive soft elastic member 1*a*, an electrically conductive layer 1*b* laminated thereon, being thereby supported, and a dielectric layer 1*c* provided on the electrically conductive layer 1*b*, on the surface facing the developing sleeve 3. The developing blade 1 is a blade-shaped, electrically conductive rigid member, and in this embodiment, it is indirectly glued to the developing container 7 through a steel blade 2. With this arrangement, the developing blade 1 is placed in contact with the surface of the developing sleeve 3, with a predetermined pressure. The method for establishing electrical connections in this embodiment is the same as that in the embodiment illustrated in FIG. 3. The developing blade 1, toner T, and developing sleeve 3, which are used in this embodiment, are the same as those of the embodiment illustrated in FIG. 1.

The developing sleeve 3 is connected to a superimposed voltage applying means 6 for applying the developing bias. Electrical field generating means 30 for providing the blade bias, which is one of the characteristics of the present invention, is connected to the steel blade 2 of the developing blade 1.

The superimposed voltage applying means 6 comprises a DC power source 10 connected to the developing sleeve 3, and a grounded AC power source 11 connected thereto. In this embodiment, the DC voltage of the power source 10 is −500 V, and the AC voltage of the power source 11 has a frequency of 1,800 Hz and a peak-to-peak voltage of 1,640 Vpp.

The electrical field generating means 30 comprises a DC power source 12, a terminal A, a terminal B, and a changeover switch SW. The DC power source 12 is connected between the DC power source 10 of the voltage applying means 6 and the AC power source 11. The terminal B is connected to the DC power source 12, and the terminal A is connected to the developing sleeve side of the DC power source 10. The changeover switch SW is connected to the steel blade 2 of the developing blade 1 so as to switch between the terminals A and B.

When the changeover switch SW is connected to the terminal A, the superimposed voltage applying means 6 is connected to the steel blade 2, and a superimposed voltage equal to the voltage being applied to the developing sleeve 3 is applied to the developing blade 1 by the DC power source 10 and AC power source 11. As a result, an electrical field is not generated in the nip 4 between the developing blade 1 and developing sleeve 3.

On the other hand, when the changeover switch SW is connected to the terminal B, the DC power source 12 of the electrical field generating means 30 and the AC power source 11 of the superimposed voltage applying means 6 are connected to the steel blade 2. Since the superimposed voltage from the AC power source 11 is also being applied to the developing sleeve 3, the DC voltage from the DC power source 12 and the DC voltage from the DC power source 10 create a potential difference between the developing blade 1 and developing sleeve 3 across the nip 4. Therefore, an electrical field is induced toward the developing sleeve 3 from the developing blade 1 in the nip 4.

In this embodiment, the DC voltage of the DC power source 12 is +500 V, and a potential difference of 1,000 V is generated between the developing blade 1 and developing sleeve 3 (−500 V) in the nip 4, in the form of a pulse having a frequency of 1,000 Hz.

These superimposed voltage applying means 6 and electrical field generating means 30 are connected to a controller 9 of an unillustrated image forming apparatus so that their operations can be controlled by the controller 9. In this embodiment, the switching between the terminals A and B by the changeover switch SW is carried out at a frequency of 1,000 Hz.

Here, the operation of the developing apparatus according to the present invention will be described. When an unillustrated image forming apparatus comprising the developing apparatus 8 begins to operate, the controller 9 shown in FIG. 10 issues a command to rotate the developing sleeve 3, and at the same time, a command to drive the superimposed voltage applying means 6 and electrical field generating means 30, which causes the superimposed voltage (developing bias) composed of the DC voltage of −500 V and DC voltage of 1,640 V (1,800 Hz) to be applied to the developing sleeve 3, and also, causes the superimposed voltage (blade bias) composed of the DC voltage of +500 V and the AC voltage of 1,640 V (1,800 Hz) to be applied to the developing blade 1. As a result, an electrical field E having the potential difference of 1,000 V is developed toward the developing sleeve 3 from the developing blade 1 in the nip 4, in the form of a pulse signal having a frequency of 1,000 Hz.

In the immediately preceding embodiment, a predetermined electrical field is continuously maintained between the developing blade 1 and developing sleeve 3. In such a case, once the redistribution of the toner T occurs, the normal toner T1 is held on the surface of the developing blade 1 by the continuously maintained electrical field, and the electrical field E attenuates as it is canceled by the charge of the toner T1 itself. Further, since the developing blade 1 is made of elastic material, and also, the contact pressure between the developing blade 1 and developing sleeve 3 in the nip 4 is constant, the toner is packed between the developing blade 1 and developing sleeve 3 in the nip 4, and therefore, is prevented from being further redistributed.

On the contrary, in this embodiment, the electrical field E is pulsed, i.e. turned on and off; therefore, while the electrical field E is off, the force holding the normal toner T1 on the surface of the developing blade 1 is reduced, and as a result, the normal toner T1 is pulled away by the toner coat layer on the developing sleeve 3, being removed from the surface of the developing blade 1. Then, when the electrical field E is subsequently turned on, there is nothing to interfere with the electrical field E; therefore, the toner T re-distribution occurs again.

In this embodiment, the developing blade 1 comprises the soft elastic member 1*a* to provide flexible elasticity; therefore, the contact pressure between the developing blade 1 and developing sleeve 3 in the nip 4 becomes stronger or weaker as the pulsating electrical field is generated. As a result, the toner in a state of being packed between the developing blade 1 and developing sleeve 3 is temporarily unpacked, which facilitates movement of the toner T by the electrical field E.

As is evident from the preceding description, the present invention increases the contact chance between the reversal toner T2 and the surface of the developing sleeve 3, which assures that the toner T is normally charged through the normal tribo-electrical charging process and becomes the normal toner. In other words, the reversal toner is eliminated, and images suffering from no reversal fog can be produced through a preferable development process.

Embodiment 6

Figure 12:
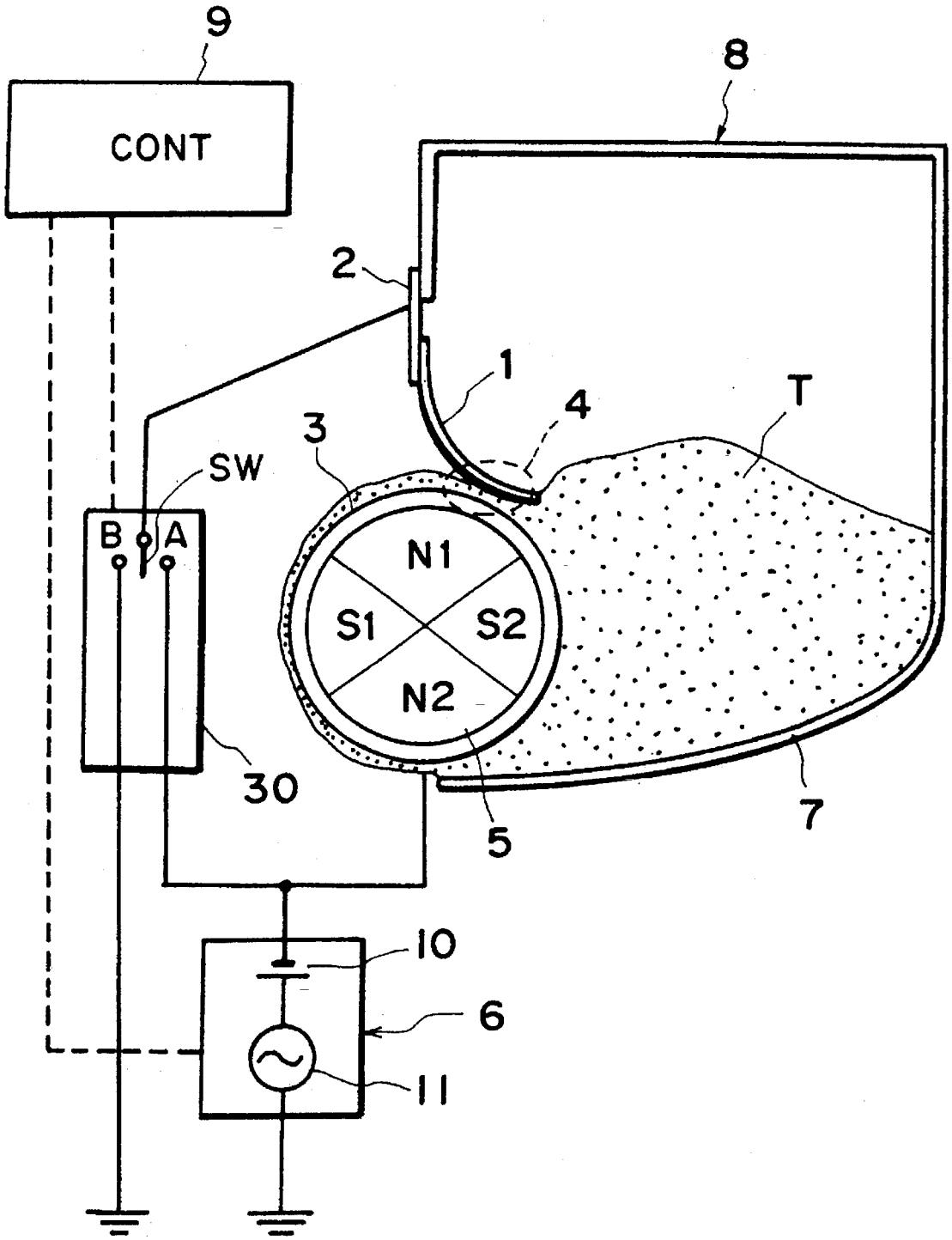
FIG. 12 is a schematic structural view of a further embodiment of the developing apparatus according to the present invention.

FIG. 12 is a drawing for depicting the developing blade and its surroundings of another embodiment of the developing apparatus according to the present invention. This embodiment is similar to Embodiment 1 except that the DC power source 12 of Embodiment 1 described in FIGS. 1–5 is eliminated and the terminal B of the electrical field generating means 30 is grounded.

Therefore, when the changeover switch SW is connected to the terminal A, the operation is the same as that in Embodiment 1; in other words, the superimposed voltage applying means 6 is connected to the steel blade 2, whereby a superimposed voltage equal to that being applied to the developing sleeve 3 is applied to the developing blade 1 by the DC power source 10 and AC power source 11. As a result, no electrical field is generated in the nip 4 between the developing blade 1 and developing sleeve 3.

On the other hand, when the changeover switch SW is connected to the terminal B, the steel blade 2 is grounded. This connection changeover from the terminal A to terminal B through this changeover switch SW is carried out at a frequency of 1,800 Hz, which is the same as the frequency of the AC component of the developing bias, with such a timing that the connection is made to the terminal B when the maximum development promoting voltage (Vmax in FIG. 12) is applied to the developing sleeve 3. With this arrangement, a pulsating electrical field can be generated toward the developing sleeve 3 from the developing blade 1 without employing the DC power source 12.

Therefore, this embodiment also increases the chance in which the reversal toner makes frictional contact with the developing sleeve 3, being substantially reduced as more of it is normally charged by the contact. As a result, the latent image is developed by the toner on the developing sleeve 3, which has been uniformly charged to the predetermined polarity, into the preferable image with no reversal fog. Further, according to this embodiment, the electrical field generating means 30 does not require the DC power source 12; therefore, this embodiment has such an advantage that the cost can be proportionally reduced.

Embodiment 7

Figure 13:
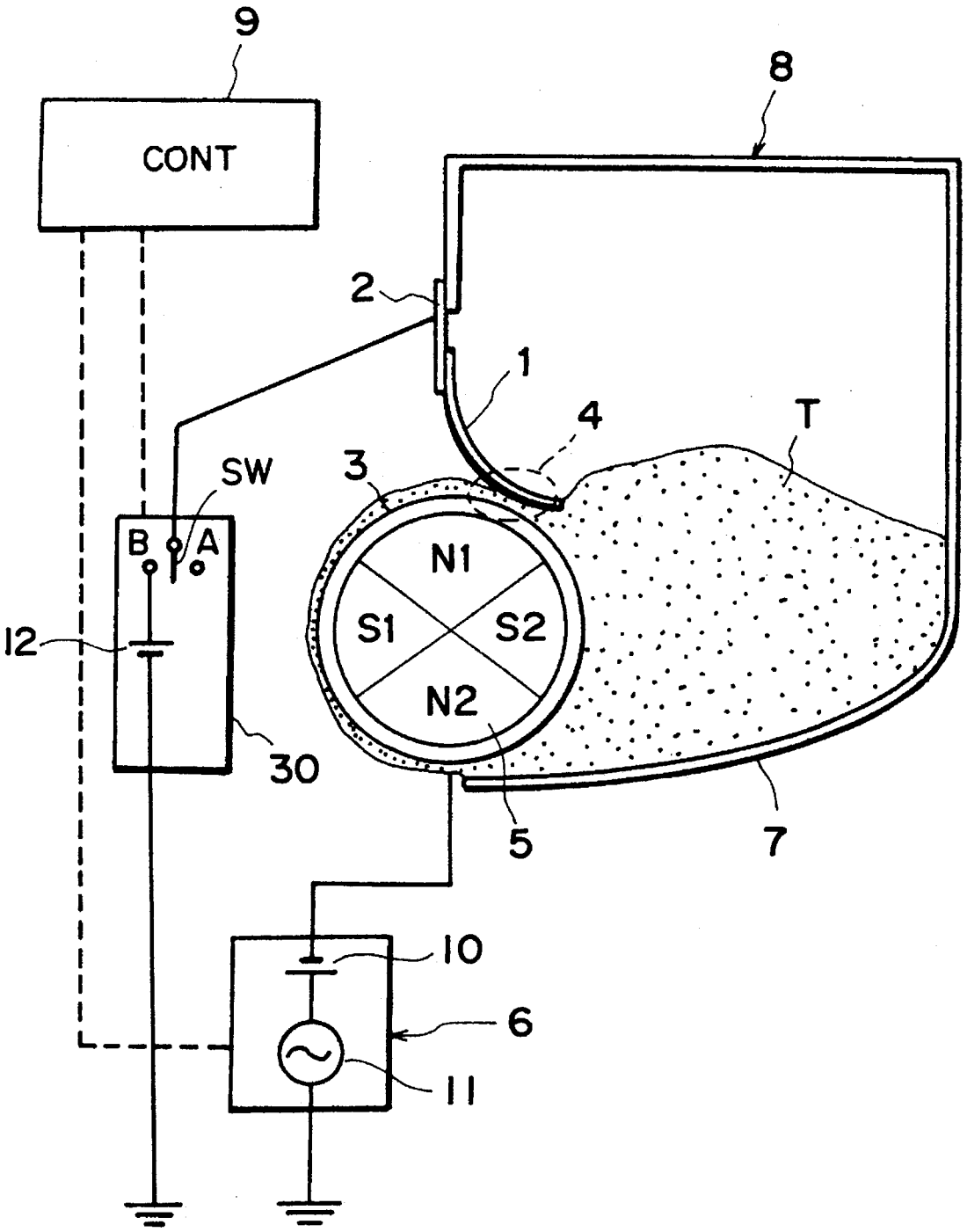
FIG. 13 is a schematic structural view of a further embodiment of the present invention.

FIG. 13 is a drawing that shows the developing blade and its surroundings of another embodiment of the developing apparatus according to the present invention. This embodiment is similar to Embodiment 2, except for one difference in which the terminal A of the electrical field generating means 30 is not connected to the superimposed voltage applying means 6, being left floating.

In Embodiments 5 and 6, the changeover switch SW is connected to the terminal A so that the same voltage as that applied to the developing sleeve 3 is applied to the electrically conductive layer 1*b* of the developing blade 1 in order to prevent the electrical field from being generated in the nip 4. However, in this embodiment, when the changeover switch SW is connected to the terminal A, the steel blade 2 becomes floating. Since the gap between this developing blade 1 and the developing sleeve 3 is microscopic, the potential of electrically conductive layer 1*b* of the developing blade 1 and that of the developing sleeve 3 become substantially the same. In other words, this state is substantially the same as that in which the changeover switch Sw is connected to the terminal A in Embodiments 1 and 2. Therefore, the electrical field E that otherwise might have affected the toner T coated on the surface of the developing sleeve 3 is going to be barely generated.

On the other hand, when the changeover switch SW is connected to the terminal B, the steel blade 2 is grounded. This connection changeover from the terminal A to the terminal B is carried out at a frequency of 1,800 Hz, which is the same as that of the AC component of the developing bias in Embodiment 2, with such a timing that the connection is made to the terminal B when the maximum development promoting voltage (Vmax in FIG. 12) is applied to the developing sleeve 3. With this arrangement, the electrical field can be pulsatingly generated toward the developing sleeve 3 from the developing blade 1 without employing the DC power source 12.

Therefore, this embodiment also increases the chance of the reversal toner making frictional contact with the developing sleeve 3, thus significantly reducing reversely charged toner. As a result, the latent image is developed by the toner on the developing sleeve 3, which has been uniformly charged to the predetermined polarity, into a preferable image with no reversal fog. Further, according to this embodiment, the electrical field generating means 30 does not require the DC power source 12; therefore, this embodiment has such an advantage that the cost can be correspondingly reduced.

Embodiment 8

Figure 14:
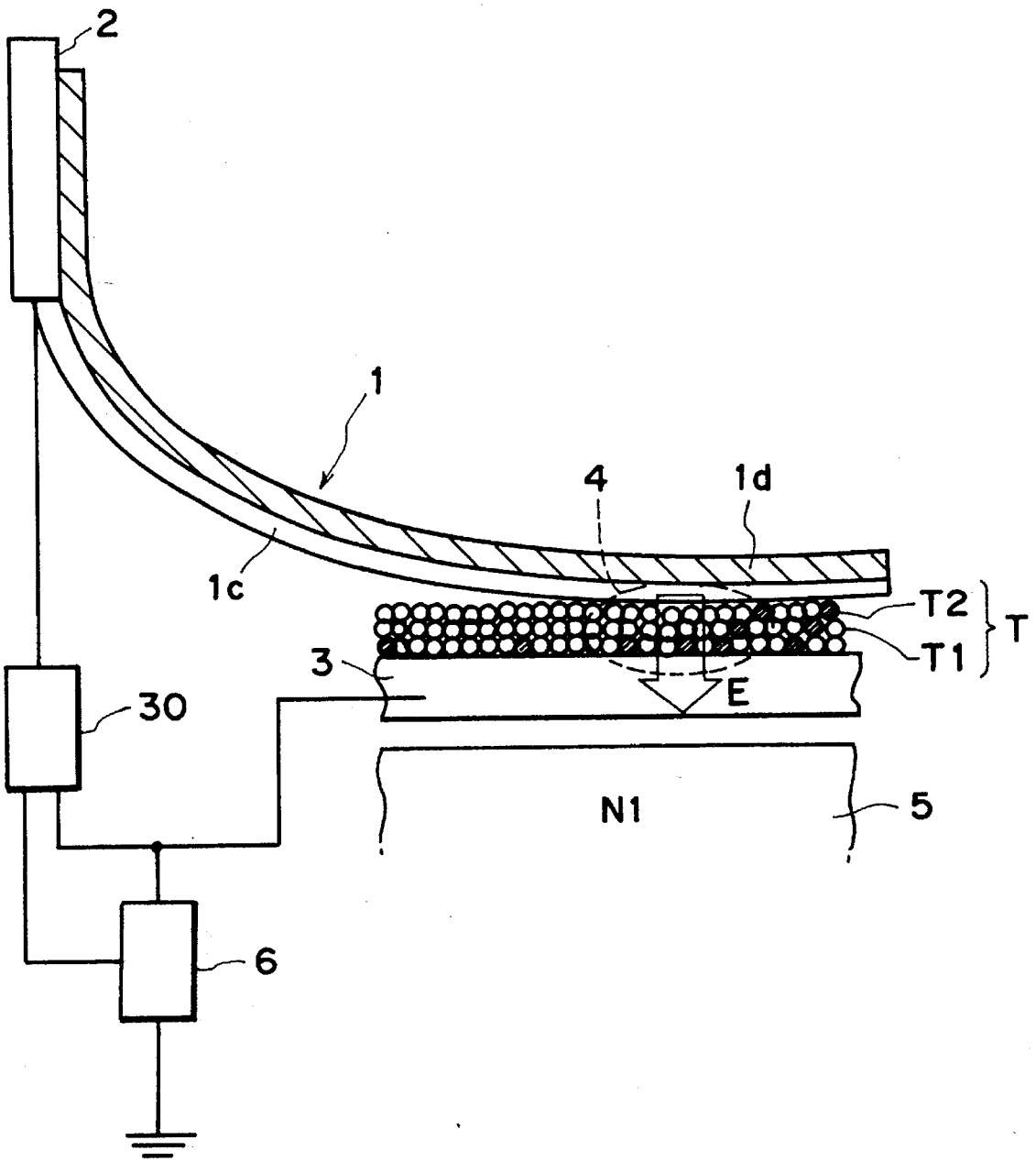
FIG. 14 is an enlarged view of the developing blade of a further embodiment of the developing apparatus according to the present invention.

FIG. 14 is a section of a portion of another embodiment of the present invention. In this embodiment, the electrically nonconductive soft elastic member 1*a*, and electrically conductive layer 1*b* provided thereon, are replaced with a single electrically conductive soft elastic member 1*d* that has a combined function of these two components, as shown in FIG. 14. In other words, the developing blade 1 of this embodiment is structured in two layers, comprising the electrically conductive soft elastic member 1*d*, and a dielectric layer 1*c* laminated thereon, on the surface facing the developing sleeve 3.

As for the material for the electrically conductive soft elastic member 1*d*, urethane rubber or the like, for example, in which carbon is dispersed, may be used. This elastic member 1*d* is placed in direct contact with the steel blade 2 with which the developing blade 1 is attached to the developer container 7.

The superimposed voltage applying means 6 and electrical field generating means 30 of this embodiment have the same structures as those in Embodiment 1, and their connections to the developing blade 1 can be switched by the changeover switch of the electrical field generating means 30.

Embodiment 9

Figure 15:
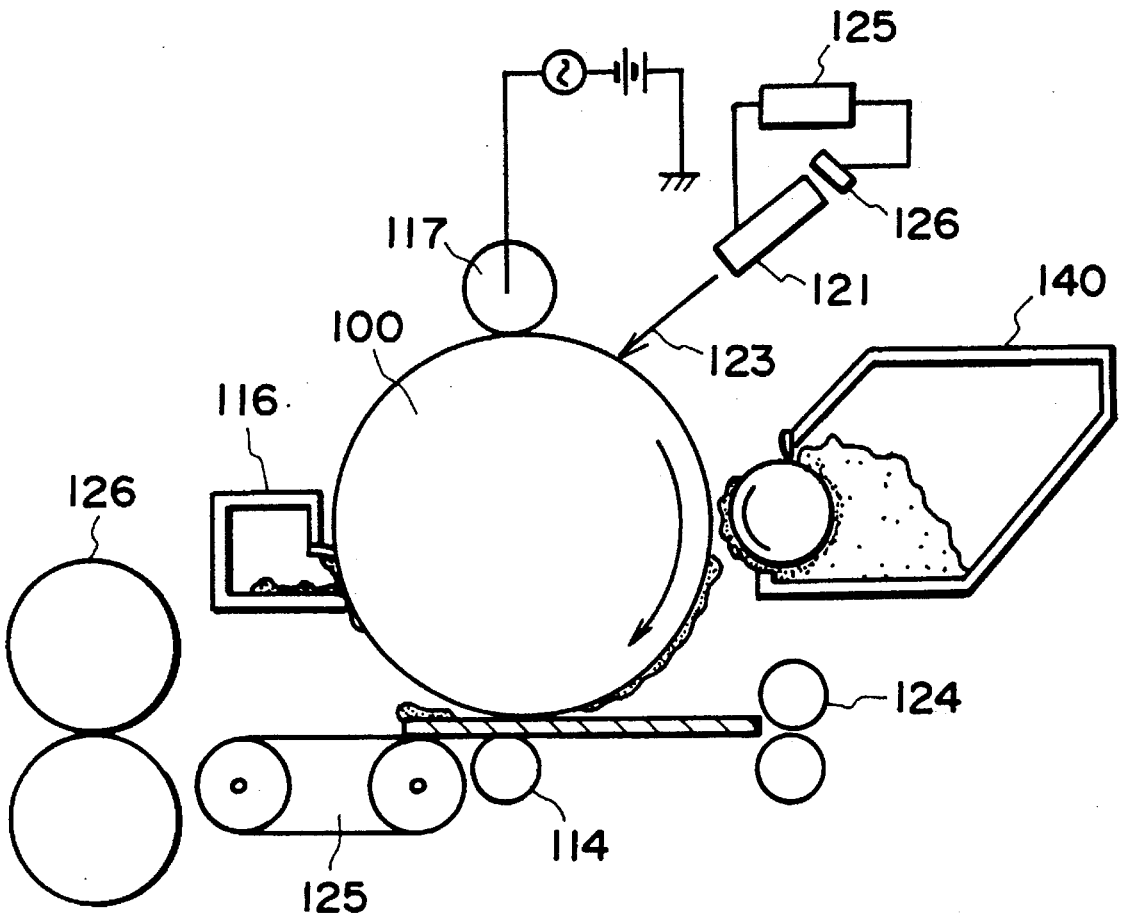
FIG. 15 is a schematic structural view of an image forming apparatus to which the developing apparatus according to the present invention is applicable.

FIG. 15 is a section of an embodiment of the image forming apparatus according to the present invention. In the drawing, a reference numeral 100 designates a photosensitive drum, which is an image bearing member. The image forming apparatus further comprises a primary charging roller 117, a developing apparatus 140, a registering roller 124, a transferring charger 114, a cleaner 116, and the like, which are disposed in a manner to surround the photosensitive drum 100.

The photosensitive drum 100 is charged by the primary charging roller 117. Then, it is exposed to a laser light 123 irradiated from a laser light generating apparatus 121, so that the surface potential of the photosensitive drum 100 is attenuated to form an electrostatic latent image on the photosensitive drum 100. The strength of the laser light to be irradiated is controlled by APC (Automatic Power Control) means; the laser light generated by the laser light generating apparatus 121 is received by an output detecting circuit 126, and in response to the detection results thereof, the strength of the laser beam 123 is regulated in a predetermined manner.

The latent image on the photosensitive drum 100 is developed into a toner image by a developing apparatus 140. The thus obtained toner image is transferred by the corona discharged by the transfer charger 114, onto a sheet of paper P delivered to the photosensitive drum 100 by the registering roller 124.

The paper P on which the toner image has been transferred is delivered by a conveyer belt 125 to a fixing apparatus 126, in which it is heated and compressed in the nip formed between fixing rollers, whereby the toner is fused to the fabric of the paper P, and solidifies; in other words, the image is fixed.

Figure 16:
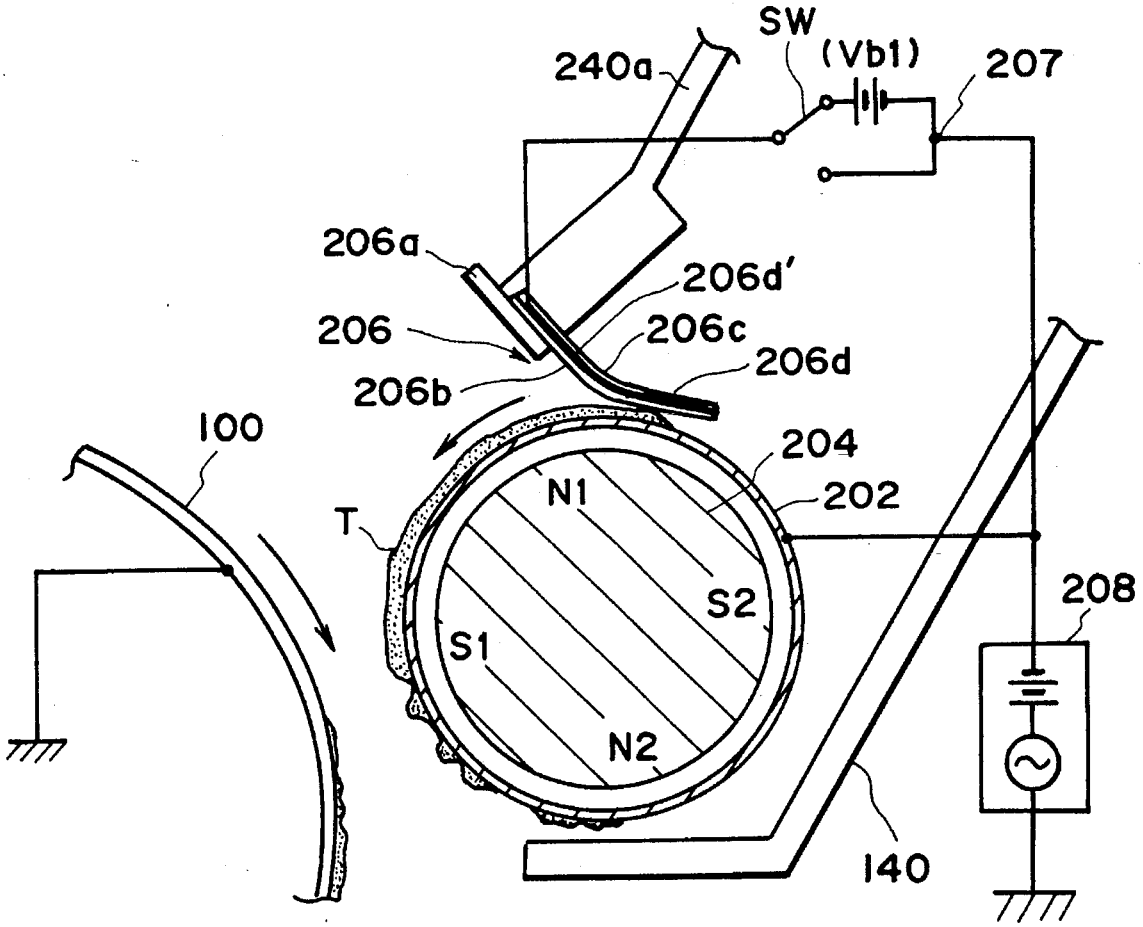
FIG. 16 is a section of a further embodiment of the present invention.

FIG. 16 is a schematic section of the developing apparatus of this embodiment. In this embodiment, the developing apparatus 140 comprises a developer container 240*a* containing electrically insulating magnetic toner T, which is one component developer, a photosensitive drum 100, a developing sleeve 202, and an elastic blade 206. The developing sleeve 202 is rotatively disposed at the opening of the developer container 240*a*, facing closely the photosensitive drum 100, and the elastic blade 206 is disposed above the developing sleeve 202 also at the opening.

The developing sleeve 202 is cylindrically formed of nonmagnetic material such as aluminum or stainless steel, and a gap of approximately 300 μm is maintained between the developing sleeve 202 and photosensitive drum 100 by an unillustrated gap regulating member. During a developing operation, a superimposed developing bias composed of an AC voltage and a DC voltage is applied to the developing sleeve 202 by a developing bias power source 208. Within this developing sleeve 202, a magnetic roller 204 as magnetic field generating means is concentrically disposed, maintaining a predetermined gap therebetween. The magnetic roller 204 is fixed to the main assembly of the image forming apparatus and does not rotate, whereas the developing sleeve 202 concentrically rotates about the magnetic roller 204 enveloped therein.

The elastic blade 206 comprises a 1.0 mm thick elastic supporting member 206*c* composed of urethane, a blade electrode 206*d*, and a 40 μm thick high resistance layer of nylon resin. The blade electrode 206*d* is disposed on the supporting member 206*c*, at a location correspondent to where the elastic blade 206 makes contact with the developing sleeve 202, and the high resistance layer 206*b* covers the blade electrode 206*d*, and the supporting member 206*c*, over the entire surface on the side facing the developing sleeve 202. The blade 206 assembly is attached to the developer container 240*a* with the use of a metallic supporting member 206*a* that supports the base portion of the assembly, so as to extend in a direction opposite to the rotational direction of the developing sleeve 202, and to make contact with the developing sleeve 202.

In this embodiment, the width of the contact portion between the elastic blade 206 and developing sleeve 202 is set to be approximately 2 mm, and the contact pressure per unit length in the width direction is set to be approximately 20 g/cm.

An electrically conductive portion 206*d'* of the electrode 206*d* is extended on the supporting member 206*c* to the base portion of the elastic blade 206, on the side facing the developing sleeve 202, and is connected to a blade power source 207, which is a DC power source, through a switch SW. The blade power source 207 is serially connected to the developing bias power source 208, wherein the connection of the electrically conductive portion 206*d'* can be switched between the blade power source 207 and the developing bias source 208 by the switch SW.

When the electrically conductive portion 206*d'* is connected to the blade power source 207 by the switch SW, a blade bias (voltage Vb1) having the same polarity as the toner charge polarity is applied to the blade electrode 206*d*, and when it is connected to the developing bias power source 208, the developing bias is applied, causing the potential of the elastic blade 206 to equal that of the developing sleeve 202.

The high resistance layer 206*b* of the elastic blade 206 is a protective layer for preventing a leak from the blade electrode 206*d* to the developing sleeve 202. In this embodiment, nylon resin is used as the material for the high resistance layer 206*b*. However, any material may be employed as long as it is chargeable to a polarity opposite the toner charge polarity, and also, has high voltage resistance.

In this embodiment, the blade electrode 206*d* extends in the axial direction of the developing sleeve 202, and its width in the circumferential direction is no more than 2 mm. The center line of the blade electrode 206*d* relative to this width falls within the contact surface area between the elastic blade 206 and developing sleeve 202. This arrangement increases the range of the electrical field generated in the nip formed between the elastic blade 206 and developing sleeve 202, and also does not disturb the toner coated on the developing sleeve 202.

Now, the developing operation of the developing apparatus of this embodiment will be described. Referring to FIG. 16, the magnetic toner T within the developer container 240 is attracted by the magnetic force of the magnetic roller 204 within the developing sleeve 202, being borne thereon as it adheres to the surface of the developing sleeve 202. As the developing sleeve 202 rotates in the direction of an arrow, the toner T borne on the developing sleeve 202 is conveyed toward a developing station, in which the developing sleeve 202 closely faces the photosensitive drum 100.

While the magnetic toner T on the developing sleeve 202 is thus conveyed, it is caused to vibrate in the nip formed between the elastic blade 206 and developing sleeve 202 in the developer regulating portion in which the elastic blade 206 is disposed, by the electrical field generated by the blade voltage being applied to the electrode 206*d* and the developing bias voltage being applied to the developing sleeve 202. As a result, the tribo-electrical charging of the toner is enhanced. At this time, the toner iS charged to the negative polarity as described previously.

The toner T delivered to the developing station is caused to fly away from the developing sleeve 202 to the surface of the photosensitive drum 100 by the electrical field generated between the developing sleeve 202 and the photosensitive drum 100 by application of the developing bias to the developing sleeve 202, where the toner adheres to a latent image borne on the photosensitive drum 100, developing it into a visual toner image.

Also in this embodiment, the regulating portion actively charges the toner, and therefore, reduces the reversal toner, which is the toner that has not been charged to the normal polarity, in the toner layer on the developing sleeve 202, while increasing the normal toner. Therefore, high quality images suffering from no image degradation such as the reversal fog can be produced.

Figure 17:
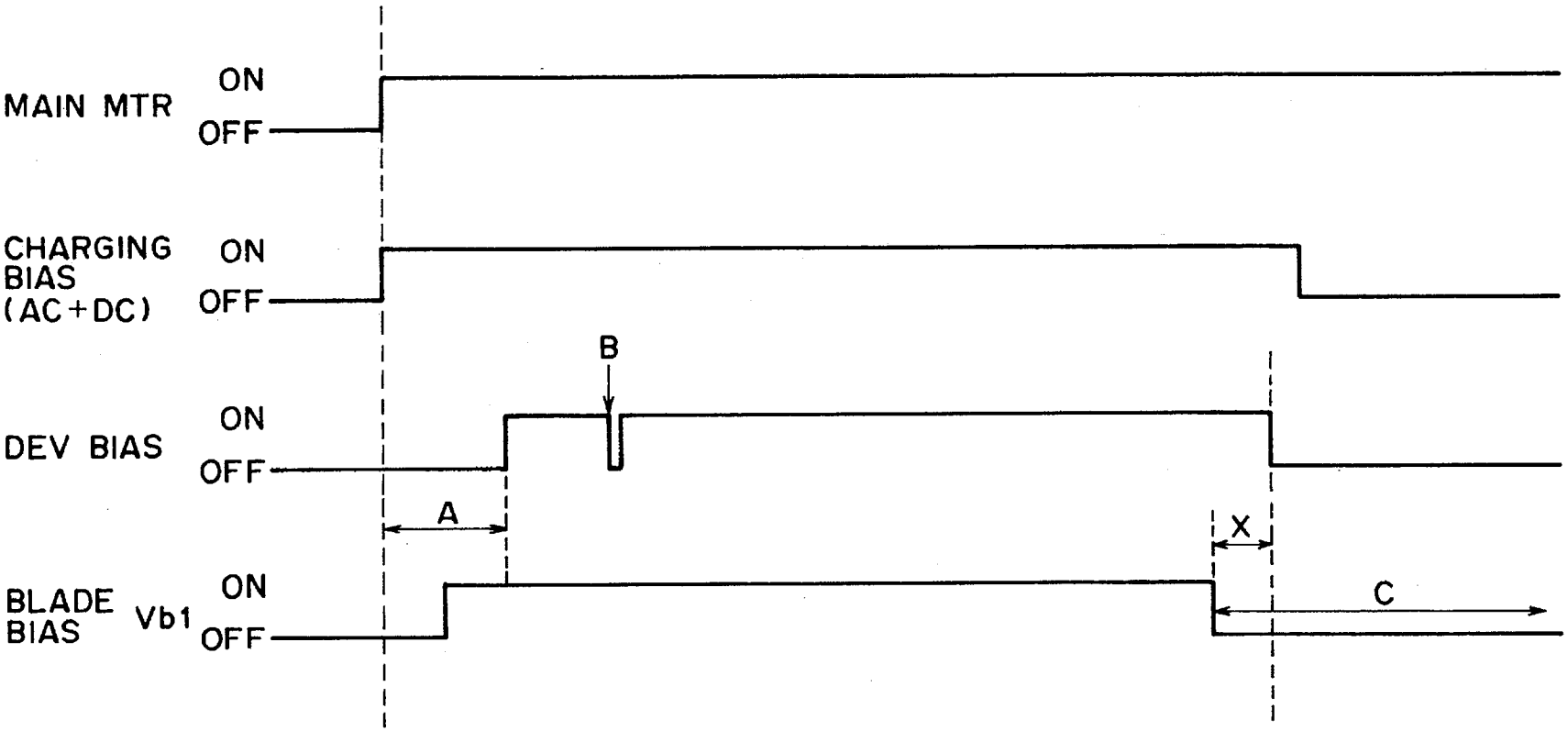
FIG. 17 is a diagram depicting an image formation sequence for the embodiment illustrated in FIG. 16.

FIG. 17 shows an image formation sequence which is followed when the developing apparatus according to the present invention is used. As soon as a main motor begins to drive the photosensitive drum 100 shown in FIG. 16, the primary charge bias (DC+AC) is turned on to charge the photosensitive drum 100, and then, the blade bias is turned on to actively charge the toner on the developing sleeve 202 in a tribo-electrical manner, in the regulating portion. After a period of A seconds after the primary charge bias is turned on, the developing bias is turned on, whereby the latent image on the photosensitive drum 100 begins to be developed by the tribo-electrically charged toner. The period of A seconds is the time required for the photosensitive drum 100 to rotate from the location where it is charged, to the developing station where its surface comes closest to that of the developing sleeve 202. The developing bias is turned off at a point B therebetween an, where APC operation is carried out in response to the results of a pre-exposure by the laser. The sequence up to this point corresponds to the pre-rotation, and is the same as that of the conventional one.

Next, after a period of X seconds after the blade bias is turned off, the developing bias is turned off, when the post-rotation begins, and then, the post-charging bias is turned off. In this embodiment, since the blade bias is turned off X seconds before the developing bias is turned off, the tribo-electrical charging of the toner which is actively carried out by the electrical field during the image forming period is not carried out; in other words, the toner charging is not enhanced. This period of X seconds is the time required for the developing sleeve 202 to rotate from the nip portion, which it forms with the elastic blade 206, to the developing station (portion where the surfaces of the elastic blade and photosensitive drum become closest). Accordingly, the toner on the developing sleeve 202 that reaches the developing station after the period of X seconds elapses does not carry a high potential; therefore, the potential on the surface of the developing sleeve 202 is not going to be increased much by the potential of this toner. Consequently, the toner that might have flown away from the developing sleeve 202 to the photosensitive drum 100 when the primary charge voltage is turned off is not going to fly away to the photosensitive drum 100. Thus, this embodiment can prevent the photosensitive drum 100 from being contaminated by the toner.

During the sequence described in the foregoing, it is preferable that the period in which the toner charging is not enhanced lasts at least a length equivalent to one rotation of the developing sleeve 202 (period C in FIG. 17). This is because unless the period exceeds the length equivalent to one rotation of the developing sleeve 202, the charged-up toner reaches the developing station as the developing sleeve 202 rotates.

Therefore, according to the present invention, soiling of the photosensitive drum by the toner is prevented during the post-rotation of the image forming apparatus after the developing operation, or while the image forming apparatus is not operating; contamination of the transferring roller by the toner is prevented; and wasteful consumption of the toner is prevented.

Embodiment 10

Figure 18:
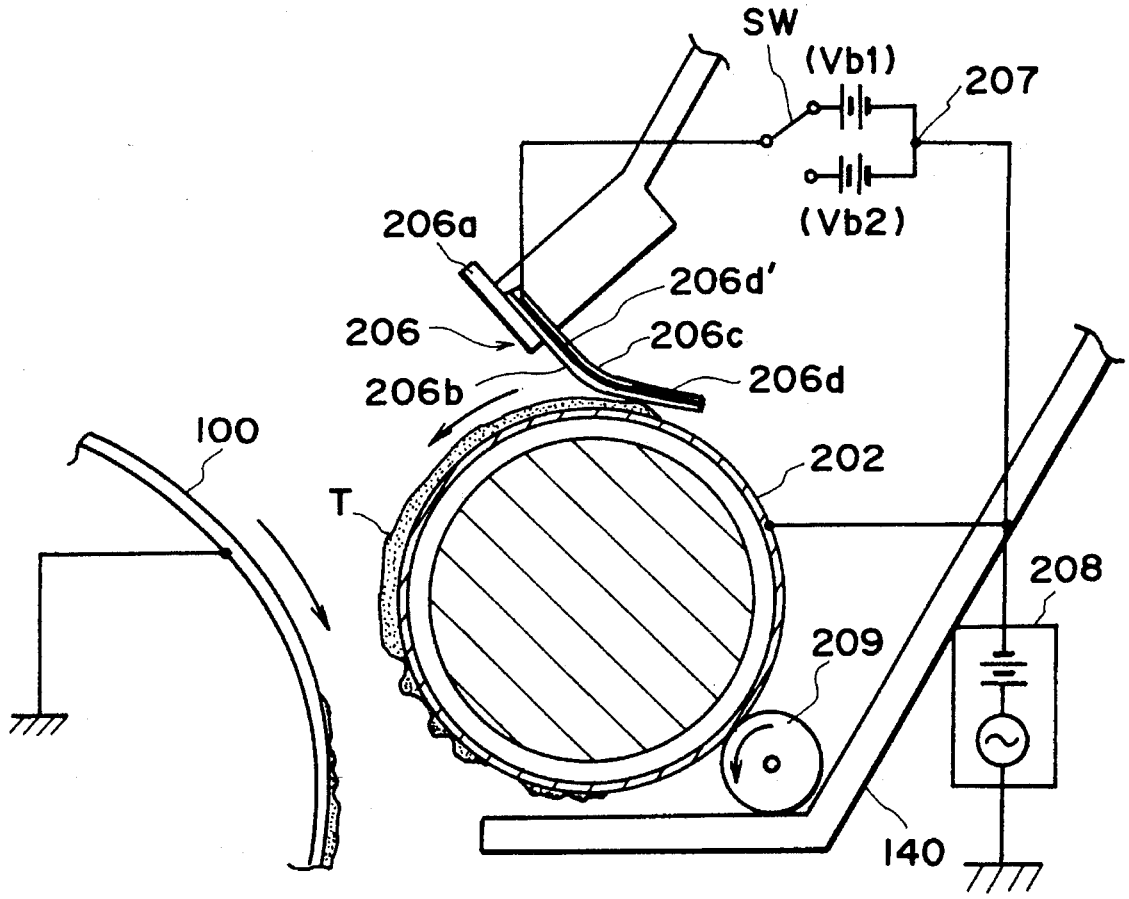
FIG. 18 is a schematic structural view of a further embodiment of a developing apparatus according to the present invention.

FIG. 18 is a schematic structural view of another embodiment of the developing apparatus according to the present invention. In Embodiment 9, the one component magnetic toner is used as the developer, whereas this embodiment presents a case in which a one component nonmagnetic toner is used. The charge polarity of the nonmagnetic toner is negative, which is the same as that in Embodiment 9.

Referring to FIG. 18, since a nonmagnetic toner is employed in this embodiment, the developing apparatus 140 does not comprise a magnetic roller that is disposed within the developing sleeve 202. Rather it, comprises a coating roller 209 that coats the toner on the developing sleeve 202, and also, peels off the charged-up toner on the developing sleeve 202. Further, the bias power source 207 of the elastic blade 206 outputs not only a blade bias (voltage Vb1), the polarity of which is opposite to the toner charge polarity outputs but also, another blade bias (voltage Vb2), the polarity of which is the same as the toner charge polarity.

Figure 19:
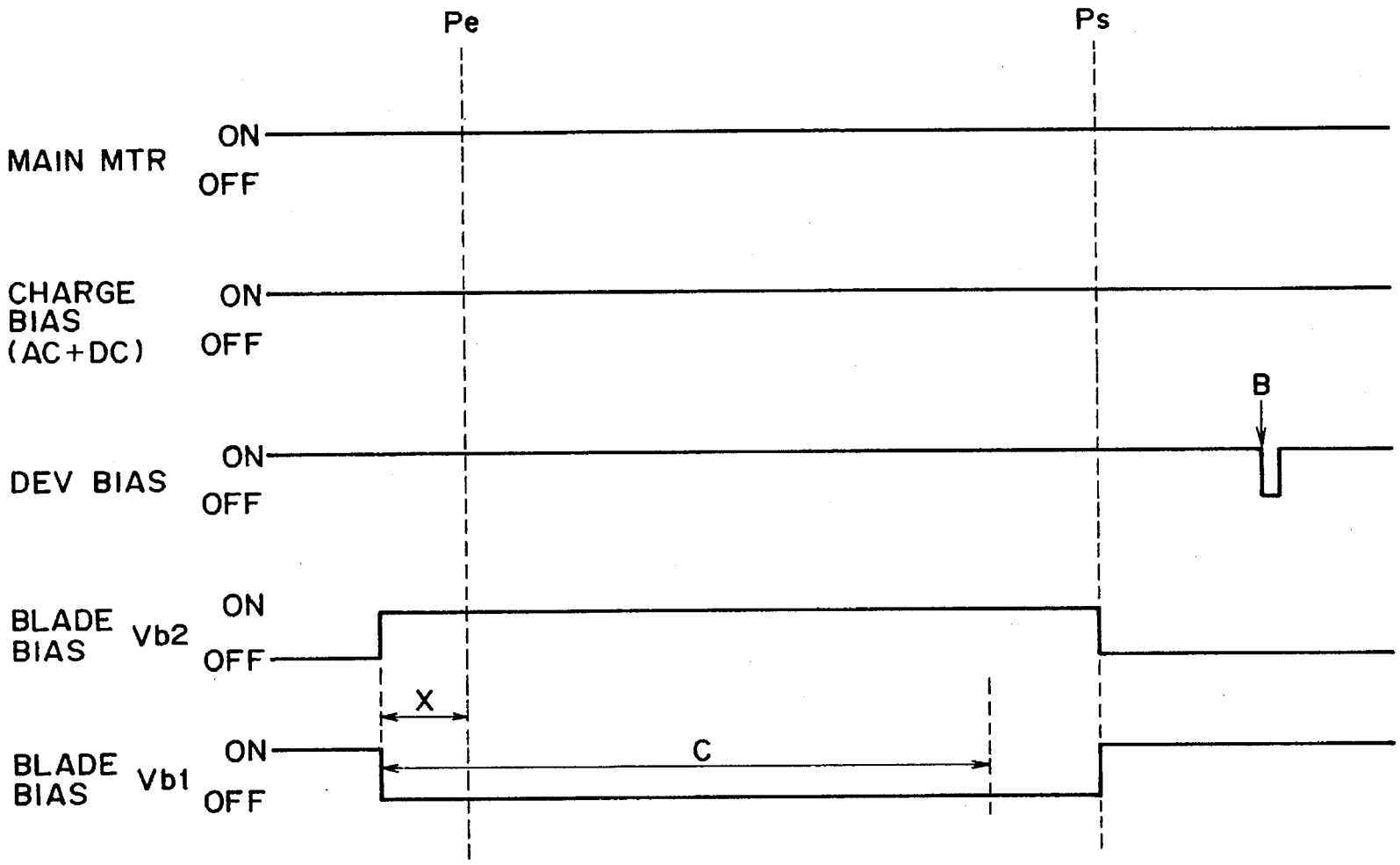
FIG. 19 is a diagram depicting an image formation sequence for the embodiment illustrated in FIG. 18.

FIG. 19 shows the image formation sequence that is followed when the developing apparatus of this embodiment is used; it shows the sequence that is carried out during the sheet intervals. In FIG. 19, the main motor of the photosensitive drum 100 and the charging bias (DC+AC) is on. A period of X seconds before a point Pe at which the developing bias is turned off to end the developing process, the output of the blade power source 207 is switched from the Vbl side that it outputs a voltage having a polarity opposite to that of the toner charge polarity to the Vb2 side that outputs a voltage having the same polarity as the toner charge polarity, so that the voltage Vb2 having the same polarity as the toner charge polarity is applied to the elastic blade 206. Then, as a print signal Ps indicated in the drawing is sent in, the blade bias is switched to the opposite one by the changeover switch SW, whereby the toner on the developing sleeve 202 is vibrated in the regulating portion, being actively charged by the friction. Then, the developing bias is turned on to start the developing process. The periods of X seconds and C seconds, and the point B of this embodiment are identical to those shown in FIG. 17.

In Embodiment 9, when the bias voltage Vb1 of the blade bias power source 207 is turned off, the polarity of the voltage applied to the elastic blade 206 is the same as that of the developing bias, whereas in this embodiment, the bias voltage Vb2 having the same polarity as the toner charge polarity is applied as described in the foregoing. This is because the nonmagnetic toner is employed as the developer.

The one component nonmagnetic toner is different from the magnetic toner in that it is composed almost entirely of resin component; therefore, it is so easily charged up that the charged-up toner increases the surface potential of the developing sleeve 202, which consequently invites such problems as image density loss, ghost, or the like, which are effected by the increased surface potential of the developing sleeve 202, during a subsequent image forming operation.

Therefore, in this embodiment, the bias voltage Vb2 having the same polarity as the toner charge polarity is applied to the elastic blade 206 during the sheet intervals, so that the electrical field induced by this voltage causes the charged toner in the toner layer on the developing sleeve 202 to be attracted toward the bottom layer, and the non-charged toner to be attracted toward the top layer. As a result, triboelectric charging of the toner is not promoted, and in addition, it is positively suppressed. Thus, in this embodiment, the charge-up of the non-magnetic toner is prevented more widely than in Embodiment 9. In other words, this embodiment can prevent even nonmagnetic toner from being charged up, enhancing further the effects of the present invention than Embodiment 9.

In addition, since the surface potential of the developing sleeve 202 is not much increased by the charge carried by the toner borne on the developing sleeve 202, the problems of the prior art, such as the density loss or ghost caused by the toner charge-up during a continuous image forming operation, can be eliminated.

Figure 20:
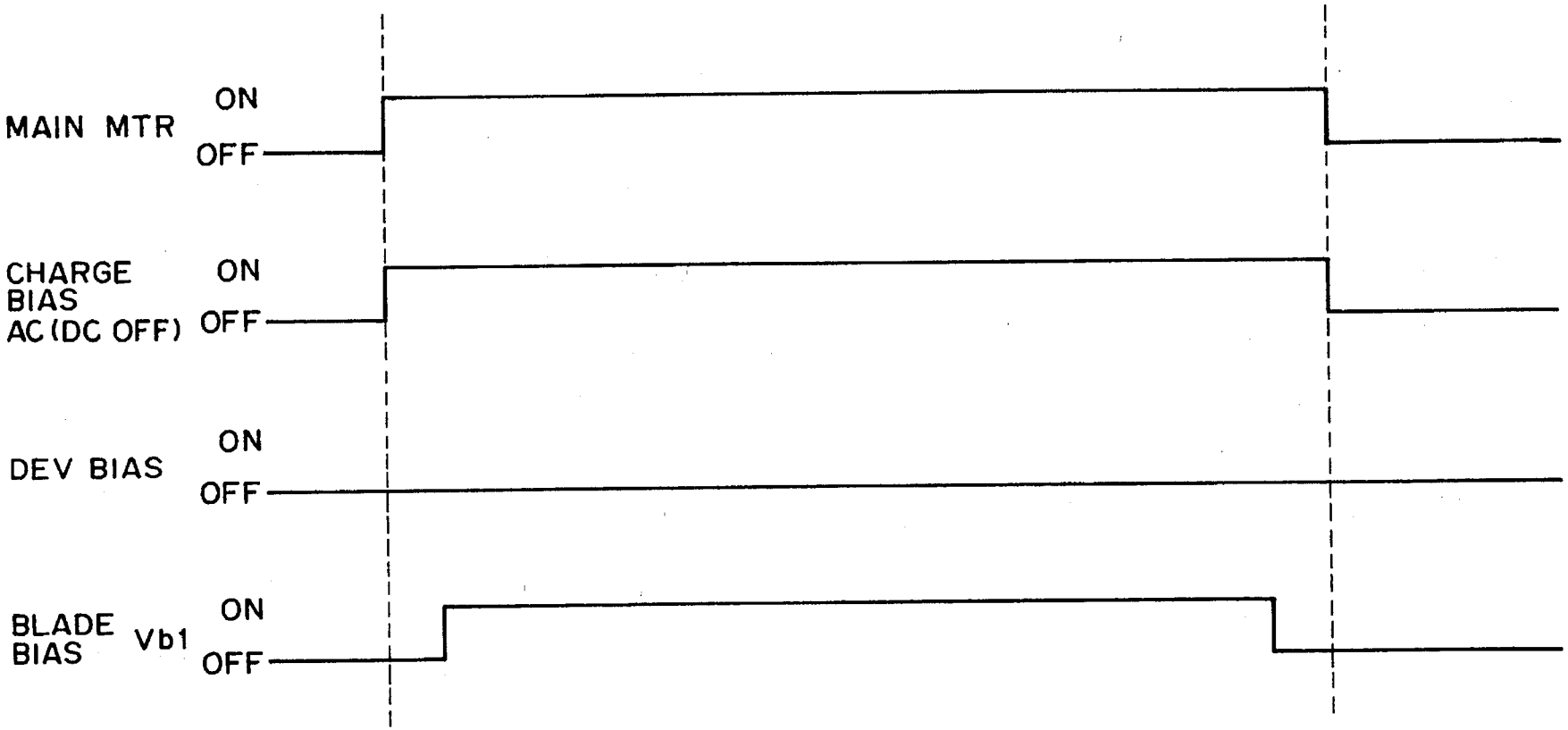
FIG. 20 also is a diagram depicting an image formation sequence for the embodiment illustrated in FIG. 18.

FIG. 20 shows a sequence followed while the image forming apparatus warms up after the electric power is turned on. As soon as the main motor begins its operation, only the AC component of the charge bias is turned on to discharge the photosensitive drum 100. Then, the bias voltage Vb1 having a polarity opposite to the toner charge polarity is selected in the blade bias power source 207 by the changeover switch SW, being applied to the elastic blade 206, so that the toner on the developing sleeve 202 is actively charged by an electric field generated between the elastic blade 206 and the developing sleeve 202 in the regulating portion. This is because the toner charge amount is low immediately after the power is turned on, and it is necessary to increase quickly the toner charge amount before the image forming apparatus warms up.

As described in the foregoing, in this embodiment, when the toner charge amount is low immediately after the power is turned on, the voltage Vb2 is applied to the elastic blade 206 to charge actively the toner by friction, and when the toner is sufficiently charged as it is during the sheet interval, the voltage Vb2 is applied to the elastic blade 206 to suppress the charging. Therefore, image defects such as photosensitive drum contamination caused by toner charge-up, or ghost, can be prevented while maintaining high image quality.

Embodiment 11

Figure 21:
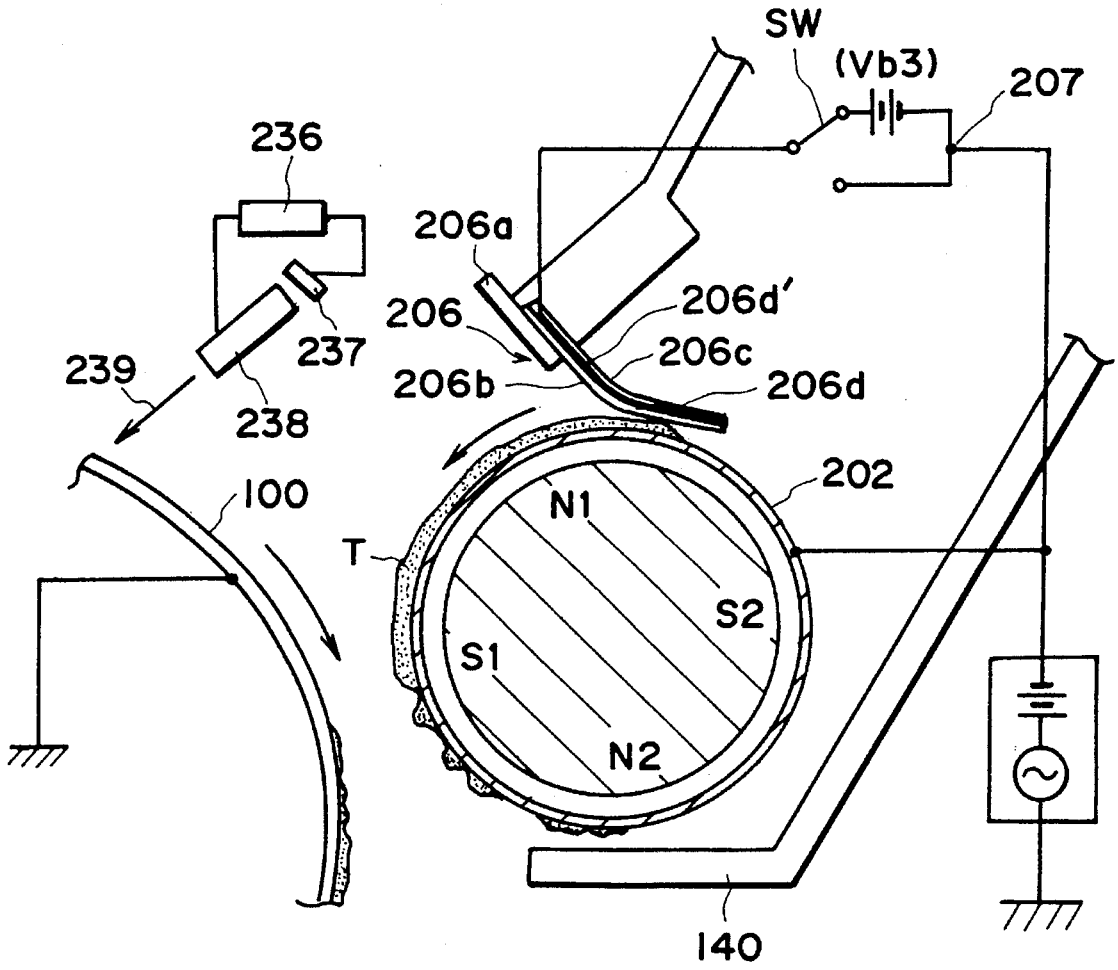
FIG. 21 is a schematic structural view of a further embodiment of the developing apparatus according to the present invention.

FIG. 21 is a schematic structural view of another embodiment of the developing apparatus according to the present invention. Also in this embodiment, the blade power source 207 that is a DC power source is connected to the electrically conductive portion 206*d'* of the elastic blade 206 through the changeover switch SW, and the developing bias power source 208 is serially connected to the blade power source 207. The blade power source 207 of this embodiment outputs a voltage Vb3 that is a bias having a polarity opposite to the toner charge polarity, whereby Vb3=+1000 V, relative to the potential of the developing sleeve 202, is applied by the blade power source 207 to the blade electrode 206*d*.

Referring to FIG. 21, a reference numeral 238 designates a semiconductor laser constituting an exposing apparatus, which irradiates a laser light 239 to the photosensitive drum 100. During the operational period of the APC, a portion of laser light 239 outputted from the laser 238 is received by an output detecting circuit 237, and the strength of the laser light 239 is regulated to a predetermined level by the APC circuit 236.

Figure 22:
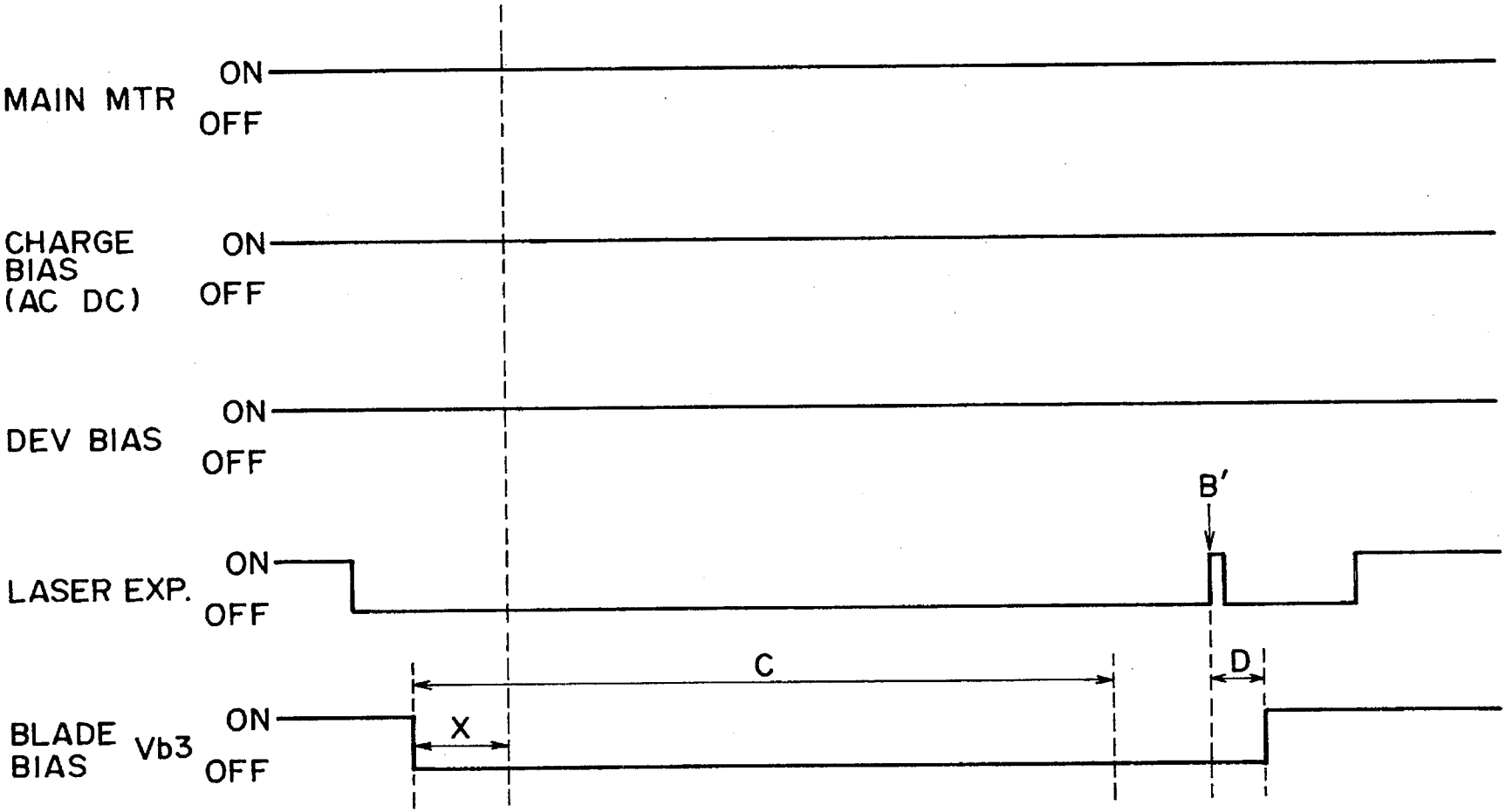
FIG. 22 is a diagram depicting the image formation sequence for the embodiment illustrated in FIG. 21.

FIG. 22 shows the image formation sequence for this embodiment. It is a sequence followed during the sheet intervals. The main motor, charging bias, and developing bias are left on as it is in Embodiment 10.

As soon as the developing process ends, the laser is turned off. Then, as shown in Embodiment 10, the blade bias is caused to equal the developing bias, so that the photosensitive drum is prevented from being soiled by toner charge-up. Next, in order to equalize the toner charge amount on the developing sleeve 202, the developing sleeve 202 is rotated more than once. In FIG. 22, periods C and X are the same as those in Embodiment 9. A reference B' designates a point at which the laser light is irradiated to control the laser exposure amount through the APC. A period D is the difference between the time required for the photosensitive drum to rotate from the exposure location to the developing station, and the time (X) required for the developing sleeve 202 to rotate from the contact location, where the developing sleeve 202 makes contact with the elastic blade 206, to the developing station.

During a continuous image forming operation, after a predetermined length of time elapses, the APC process is first carried out to adjust the laser exposure amount so that a subsequent developing process can be started, and then, D seconds later, the bias voltage Vb3 is applied to the elastic blade 206 to begin the developing process.

The characteristic of this embodiment is found in the following point. That is, in the case of the prior art, while the APC is carried out, the potential of the exposed portion of the photosensitive drum surface drops, whereby the photosensitive drum is soiled by the toner when the applied developing bias is left as it is; therefore, the developing bias must be turned off. On the contrary, in this embodiment, the blade bias is applied to the blade electrode 206*d*, with such a timing that the surface portion of the photosensitive drum 100 exposed for adjustment of the laser output passes the developing station, the surface portion of the developing sleeve 202 correspondent to the time at which the bias is applied to the electrode 206*d* of the elastic blade 206 passes the developing station; therefore, even when the developing bias being applied to the developing sleeve 202 is left as it is, the toner is not coated on the developing sleeve 202. In other words, in this embodiment, the laser beam intensity is controlled without the necessity of turning off the developing bias voltage for each APC, and the thus controlled laser beam is projected onto the photosensitive drum 100 to form the latent image.

Figure 23:
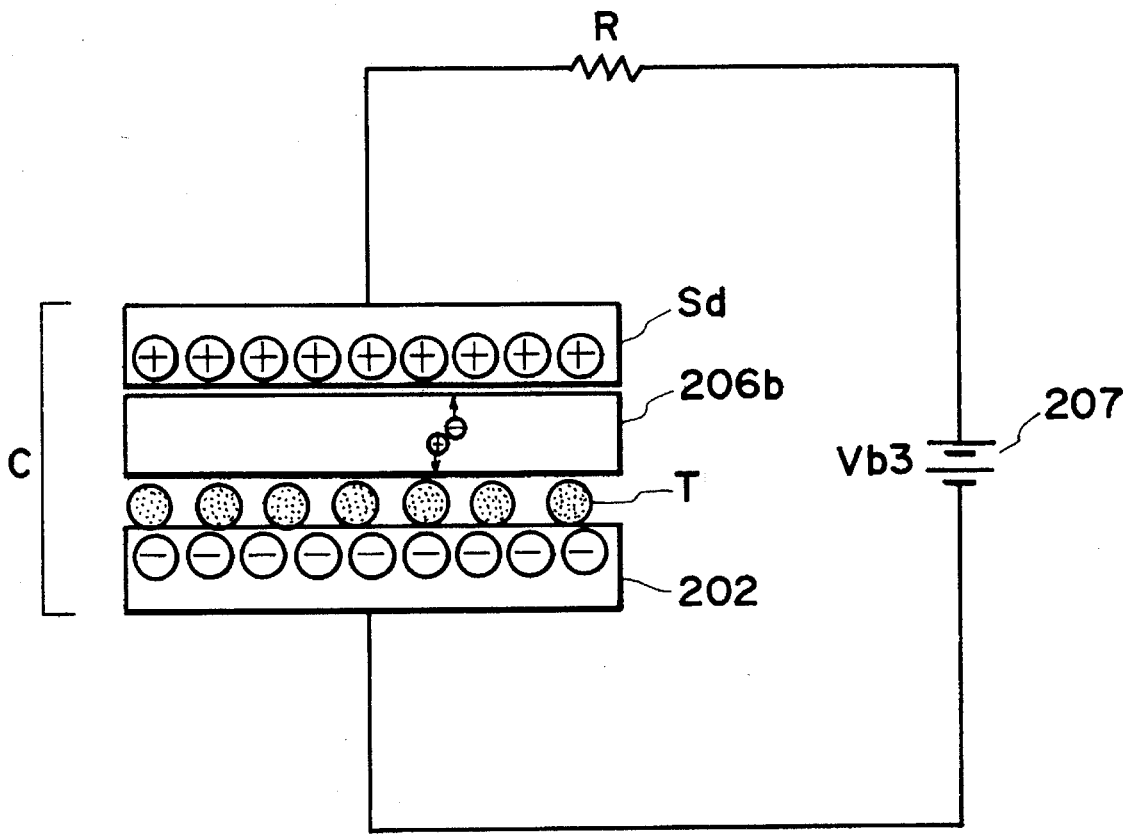
FIG. 23 is a drawing for describing how the contact pressure of the elastic blade on the developing sleeve is increased in the developing apparatus illustrated in FIG. 21.

Next, the principle that prevents the toner from being coated on the developing sleeve will be further described. FIG. 23 depicts an equivalent circuit established between the blade electrode 206*d* of the elastic blade 206 and developing sleeve 202 shown in FIG. 22. Between the developing sleeve 202 and electrode 206*d*, the blade bias voltage Vb3 is applied by the power source 235. The surface of the electrode 206*d* is laminated with a leak preventing high resistance layer of nylon resin 206*b*, and the toner T is delivered between this high resistance layer 206*b* and developing sleeve 202.

As the blade bias Vb3 is applied between the developing sleeve 202 and blade electrode 206*d*, a positive charge is induced on the blade electrode 206*d*, and a negative charge is induced on the developing sleeve 202. Since the polarization between the high resistance nylon resin layer 206*b* and toner T falls behind, an attractive force is present between the blade electrode 206*d* and developing sleeve 202 during the transient state at the beginning of the bias application. In other words, the apparent contact pressure of the elastic blade 206 increases, whereby a region on which the toner is not coated is created on the developing sleeve 202. When this region on which the toner is not coated and the photosensitive drum 100 portion exposed by the laser light for the APC operation are synchronously delivered to the developing station, the APC operation can be carried out without turning off the developing bias.

As the high resistance nylon resin layer 206*b* becomes polarized after the transient state elapses, the force working to attract the elastic blade 206 to the developing sleeve 202 decreases, leaving only the elastic pressure of the blade itself as the contact pressure of the elastic blade 206, and as a result, the toner begins to be coated on the developing sleeve 202.

The inventors of the present invention conducted an experiment using the developing apparatus shown in FIG. 21, in which it was tested how far the non-toner-coated region extended on the developing sleeve 202 under a condition in which the peripheral velocity of the developing sleeve 202 was set at 47 mm/sec and the developing station length in the peripheral direction was set at 2 mm. Under this condition, in order to make it unnecessary to turn off the developing bias at least during the APC operation, it was required to prevent the toner from being coated on the developing sleeve 202 for 43 mmsec.

According to the results of the experiment, when the time constant of the equivalent circuit was 0.5 second while the blade bias Vb3 of +1000 V was applied, it was possible to create a non-toner-coated region extending no less than 2 mm in the peripheral direction. Further, the startup waveform of the applied bias voltage was studied, and the results were such that any startup waveform was acceptable as long as it had a predetermined time constant.

While the invention has been described with reference to its specific embodiments, it is not confined to the details set forth and this application is intended to cover such modifications or changes as may come within the purposes of the improvements or the scope of the following claims.

What is claimed is:

1. An image forming apparatus comprising:

an image bearing member for bearing an electrostatic image having a predetermined polarity;

a developer carrying member, opposed to said image bearing member, for carrying a one component developer which is charged to the same polarity as the electrostatic image by friction between the developer and said developer carrying member;

electric field generating means for forming a developing electric field between said image bearing member and said developer carrying member;

a regulating member for regulating an amount of the developer on said developer carrying member, said regulating member having an electroconductive layer and a dielectric layer located between said electroconductive layer and the developer on said developer carrying member; and voltage applying means for applying a voltage to the conductive layer to form an electric field which applies to developer having a polarity opposite the predetermined polarity a force urging the opposite polarity developer in a direction from said regulating member toward said developer carrying member.

2. An image forming apparatus according to claim 1, wherein said regulating member is flexible, and is elastically pressed upon said developer carrying member.

3. An image forming apparatus according to claim 1, wherein said dielectric layer is composed of rubber.

4. An image forming apparatus according to claim 1, wherein the dielectric layer is composed of polyamide.

5. An image forming apparatus according to claim 1, wherein said developer carrying member comprises a surface layer of resin material.

6. An image forming apparatus according to claim 5, wherein the surface layer of resin material contains graphite.

7. An image forming apparatus according to claim 1, wherein said electric field generating means generates an alternating electric field between said image beraing member and developer carrying member.

8. An image forming apparatus according to claim 1, wherein said voltage applying means applies a pulsating voltage to said regulating member.

9. An image forming apparatus according to claim 1, wherein said voltage applying means turns off the voltage during the non-developing operation.

10. An image forming apparatus according to claim 1, wherein during a developing operation, said voltage applying means applies to said conductive layer a voltage having a polarity opposite the polarity of the developer, and during a non-developing operation, said voltage applying means applies a voltage to said conductive layer having the same polarity as the developer.

11. An image forming apparatus comprising:

an image bearing member for bearing an electrostatic image;

a developer carrying member facing said image bearing member, for carrying a one component developer which is charged to a predetermined polarity by friction between the developer and said developer carrying member;

an elastic regulating member, elastically pressed upon said developer carrying member, for regulating an amount of the developer on said developer carrying member, said regulating member having an electroconductive layer and a dielectric layer located between said electroconductive layer and the developer on said developer carrying member; and voltage applying means for applying a voltage to the conductive layer to form an electric field which applies to developer having a polarity opposite the predetermined polarity a force urging the opposite polarity developer in a direction from said regulating member toward said developer carrying member.

12. An image forming apparatus according to claim 11, wherein said dielectric layer is composed of rubber.

13. An image forming apparatus according to claim 11, wherein the dielectric layer is composed of polyamide.

14. An image forming apparatus according to claim 11, wherein said developer carrying member comprises a surface layer of resin material.

15. An image forming apparatus according to claim 14, wherein the surface layer of resin material contains graphite.

16. An image forming apparatus according to claim 11, wherein said voltage applying means applies a pulsating voltage to said regulating member.

17. An image forming apparatus according to claim 11, wherein said voltage applying means turns off the voltage during the non-developing operations.

18. An image forming apparatus according to claim 11, wherein during a developing operation, said voltage applying means applies to said conductive layer a voltage having a polarity opposite the polarity of the developer, and during a non-developing operation, said voltage applying means applies a voltage having the same polarity as the developer.

* * * * *

UNITED STATES PATENT AND TRADEMARK OFFICE

CERTIFICATE OF CORRECTION

PATENT NO. : 5,570,166 Page 1 of 4

DATED : October 29, 1996

INVENTOR(S) : YUKIHIRO OHZEKI, ET AL.

It is certified that error appears in the above-indentified patent and that said Letters Patent is hereby corrected as shown below:

COLUMN 2:

Line 2, "is flown" should read --flies--.
Line 32, delete "and".
Line 61, "9" (both occurrences) should read --10--.

COLUMN 4:

Line 25, "to" should read --to a--.

COLUMN 7:

Line 59, delete "an".
Line 60, "AC" should be --DC--; and "DC" should be --AC--.

COLUMN 8:

Line 41, delete "the"; and "means" should read --is--.

UNITED STATES PATENT AND TRADEMARK OFFICE

CERTIFICATE OF CORRECTION

PATENT NO. : 5,570,166
DATED : October 29, 1996
INVENTOR(S) : Yukihiro Ohzeki, et. al.

It is certified that error appears in the above-indentified patent and that said Letters Patent is hereby corrected as shown below:

Column 11:

Line 2, "developing" should read--the developing--. (2nd occurrences). "slevee" should read --sleeve--.

COLUMN 13:

Line 21, "the" should read --a--. (1st occurrence).
Line 58, "Sw" should read --SW--.

COLUMN 16:

Line 42, "iS" should read --is--.
Line 67, "A" should read --"A"--.

UNITED STATES PATENT AND TRADEMARK OFFICE

CERTIFICATE OF CORRECTION

PATENT NO. : 5,570,166 Page 3 of 4

DATED : October 29, 1996

INVENTOR(S) : YUKIHIRO OHZEKI, ET AL.

It is certified that error appears in the above-indentified patent and that said Letters Patent is hereby corrected as shown below:

COLUMN 17:

Line 8, "an, where" should read --, where an--.
Line 62, "Rather it," should read --Rather, it--.

COLUMN 19:

Line 43, "it is" should read --they are--.

COLUMN 21:

Line 32, "developer" should read --the developer--.
Line 50, "beraing" should read --bearing--.
Line 51, "developer" should read --said developer--.

UNITED STATES PATENT AND TRADEMARK OFFICE

CERTIFICATE OF CORRECTION

PATENT NO. : 5,570,166 Page 4 of 4

DATED : October 29, 1996

INVENTOR(S) : YUKIHIRO OHZEKI, ET AL.

It is certified that error appears in the above-indentified patent and that said Letters Patent is hereby corrected as shown below:

COLUMN 22:

Line 28, "developer" should read --the developer--.
Line 46, "operations." should read --operation.--.

Signed and Sealed this

Sixth Day of May, 1997

Bruce Lehman

*Attest:*

BRUCE LEHMAN

*Attesting Officer*

*Commissioner of Patents and Trademarks*